US011303987B2

(12) United States Patent
Li et al.

(10) Patent No.: US 11,303,987 B2
(45) Date of Patent: Apr. 12, 2022

(54) LOUDSPEAKER APPARATUS

(71) Applicant: SHENZHEN SHOKZ CO., LTD., Guangdong (CN)

(72) Inventors: Chaowu Li, Shenzhen (CN); Zhuyang Jiang, Shenzhen (CN); Fen You, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 0 days.

(21) Appl. No.: 17/030,484

(22) Filed: Sep. 24, 2020

(65) Prior Publication Data

US 2021/0014602 A1 Jan. 14, 2021

Related U.S. Application Data

(63) Continuation of application No. PCT/CN2019/102387, filed on Aug. 24, 2019.

(30) Foreign Application Priority Data

Jan. 5, 2019 (CN) ..... 201910009887.3

(51) Int. Cl.
*H04R 1/10* (2006.01)
*H04R 1/02* (2006.01)
*H04R 1/28* (2006.01)

(52) U.S. Cl.
CPC ..... *H04R 1/1041* (2013.01); *H04R 1/026* (2013.01); *H04R 1/10* (2013.01); *H04R 1/105* (2013.01);
(Continued)

(58) Field of Classification Search
CPC ..... H04R 1/1041; H04R 1/026; H04R 1/10; H04R 1/28; H04R 1/1008; H04R 1/105;
(Continued)

(56) References Cited

U.S. PATENT DOCUMENTS 5,784,470 A 7/1998 Fackler et al.
7,539,525 B2 * 5/2009 Kim ..... H04M 1/05 379/433.13
(Continued)

FOREIGN PATENT DOCUMENTS

CN 202488645 U 10/2012
CN 203827497 U 9/2014
(Continued)

OTHER PUBLICATIONS

International Search Report in PCT/CN2019/102387 dated Nov. 29, 2019, 8 pages.
(Continued)

*Primary Examiner* — Oyesola C Ojo
(74) *Attorney, Agent, or Firm* — Metis IP LLC

(57) ABSTRACT

The present disclosure discloses a loudspeaker apparatus, including an earphone core housing configured to accommodate an earphone core; and a circuit housing including an accommodating body and a cover. The accommodating body may include a cavity with an opening at one end, and the cover may be disposed on the opening for sealing the cavity. The circuit housing may accommodate a control circuit. The control circuit may drive the earphone core to vibrate to generate sound. The loudspeaker apparatus may further include an ear hook configured to connect the earphone core housing and the circuit housing, and a button disposed at a button hole on the circuit housing. The button may move relative to the button hole to generate a control signal for the control circuit. The loudspeaker apparatus may further include an elastic pad disposed between the button and the button hole. The elastic pad may hinder a movement of the button toward the button hole. In the present disclosure, a waterproof effect of the loudspeaker apparatus may be improved and a space occupied by a button may be
(Continued)

reduced by providing an elastic pad between the button and the button hole.

19 Claims, 16 Drawing Sheets

(52) U.S. Cl.
CPC ..... *H04R 1/1008* (2013.01); *H04R 1/1066* (2013.01); *H04R 1/1075* (2013.01); *H04R 1/1091* (2013.01); *H04R 1/28* (2013.01); *H04R 2460/13* (2013.01)

(58) Field of Classification Search
CPC ..... H04R 1/1075; H04R 1/1091; H04R 2460/13; H04R 2201/107; H04R 1/347; H04R 2201/103; H04R 1/1066; H04R 2225/0213; H04R 1/2857; H04R 2225/63
See application file for complete search history.

(56) References Cited

U.S. PATENT DOCUMENTS

| | | | | |
|---|---|---|---|---|
| 8,654,987 | B2 * | 2/2014 | Palma | H04R 1/1041 381/74 |
| 9,049,515 | B2 * | 6/2015 | Clow | H04R 1/1091 |
| 10,149,041 | B2 * | 12/2018 | Qian | H04R 1/1016 |
| 10,154,334 | B1 * | 12/2018 | Lin | H04R 1/1041 |
| 10,299,025 | B2 * | 5/2019 | Sakai | H04R 1/1041 |
| 10,735,842 | B2 * | 8/2020 | Prasad | A44C 7/003 |
| 2002/0102005 | A1 * | 8/2002 | Lin | H04R 1/1066 381/381 |
| 2009/0262964 | A1 * | 10/2009 | Havenith | H04R 25/505 381/314 |
| 2011/0110553 | A1 * | 5/2011 | Logan | H04R 1/1058 381/380 |
| 2014/0254848 | A1 | 9/2014 | Petterson et al. | |
| 2016/0007127 | A1 | 1/2016 | Kennes et al. | |
| 2016/0329041 | A1 | 11/2016 | Qi et al. | |
| 2016/0337766 | A1 | 11/2016 | Flaig | |
| 2017/0257692 | A1 * | 9/2017 | Yang | H04R 1/1016 |
| 2020/0336824 | A1 | 10/2020 | Zheng et al. | |

FOREIGN PATENT DOCUMENTS

| | | | |
|---|---|---|---|
| CN | 204289156 | U | 4/2015 |
| CN | 105007551 | A | 10/2015 |
| CN | 207010974 | U | 2/2018 |
| CN | 207039848 | U | 2/2018 |
| CN | 207070281 | U | 3/2018 |
| CN | 107948883 | A | 4/2018 |
| CN | 207783068 | U | 8/2018 |
| CN | 207968799 | U | 10/2018 |
| CN | 108882076 | A | 11/2018 |
| CN | 109061901 | A | 12/2018 |
| CN | 109121038 | A | 1/2019 |
| CN | 109547905 | A | 3/2019 |
| CN | 109769167 | A | 5/2019 |
| CN | 109788386 | A | 5/2019 |
| CN | 110022516 | A | 7/2019 |
| CN | 209089198 | U | 7/2019 |
| CN | 209184800 | U | 7/2019 |
| CN | 209358729 | U | 9/2019 |
| KR | 101934229 | B1 | 12/2018 |
| WO | 2015096434 | A1 | 7/2015 |
| WO | 2018124587 | A1 | 7/2018 |
| WO | 2018175192 | A1 | 9/2018 |

OTHER PUBLICATIONS

International Search Report in PCT/CN2019/102409 dated Nov. 28, 2019, 7 pages.
International Search Report in PCT/CN2019/102384 dated Nov. 29, 2019, 9 pages.
International Search Report in PCT/CN2018/102376 dated Oct. 30, 2019, 6 pages.
International Search Report in PCT/CN2019/102400 dated Nov. 22, 2019, 6 pages.

* cited by examiner

LOUDSPEAKER APPARATUS

CROSS-REFERENCE TO RELATED APPLICATIONS

This application is a continuation of International Application No. PCT/CN2019/102387 filed on Aug. 24, 2019, which claims priority of Chinese Patent Application No. 201910009887.3 filed on Jan. 5, 2019, the contents of each of which are incorporated herein by reference.

TECHNICAL FIELD

The present disclosure relates to a loudspeaker apparatus, and more particularly, relates to a loudspeaker apparatus having a waterproof function.

BACKGROUND

In general, people can hear sound due to that vibrations are transmitted to the eardrum through external ear canals through the air, and vibrations formed by the eardrum drive the human auditory nerve to perceive the vibrations of sound. At present, earphones have been widely used in people's lives. For example, a user may use earphones to play music, answer calls, etc. Earphones have become an important item in people's daily lives. Ordinary earphones can no longer meet the normal requirement of a user in some special scenarios. For example, the user may need to control the earphones through a button in a swimming scenario, a rainy outdoor scenario, or the like. Earphones with waterproof function and better sound quality are more favored by consumers. Therefore, it is necessary to provide a loudspeaker apparatus with a waterproof function.

SUMMARY

An embodiment of the present specification provides a loudspeaker apparatus. The loudspeaker apparatus may include an earphone core housing configured to accommodate an earphone core; a circuit housing including an accommodating body and a cover. The accommodating body may include a cavity with an opening at one end, and the cover may be disposed on the opening for sealing the cavity; the circuit housing may accommodate a control circuit, and the control circuit may drive the earphone core to vibrate to generate sound. The loudspeaker apparatus may further include an ear hook configured to connect the earphone core housing and the circuit housing; and a button disposed at a button hole on the circuit housing, which may move relative to the button hole to generate a control signal for the control circuit. And the loudspeaker apparatus may further include an elastic pad disposed between the button and the button hole. The elastic pad may hinder a movement of the button toward the button hole.

In some embodiments, the circuit housing may further include a main side wall and an auxiliary side wall connected to the main side wall, wherein an outer surface of the auxiliary side wall may include a first recess region. The elastic pad may be placed in the first recess region. The elastic pad may include a second recess region corresponding to the button hole. And the second recess region may extend into the button hole.

In some embodiments, the button may include a button body and a button contact. The button contact may extend into the second recess region. And the button body may be placed on a side of the button contact away from the elastic pad.

In some embodiments, the circuit housing may further accommodate a button circuit board. The button circuit board may include a button switch corresponding to the button hole to allow the button contact to contact and trigger the button switch when a user presses the button.

In some embodiments, the button may include at least two button monomers spaced from each other and a connecting part for connecting these button monomers, wherein each of the button monomers may be provided with one button contact. And the elastic pad may further include an elastic convex for supporting the connecting part.

In some embodiments, the loudspeaker apparatus may further include a rigid pad disposed between the elastic pad and the circuit housing. The rigid pad may include a through hole that allows the second recess region to pass through.

In some embodiments, the elastic pad and the rigid pad may be closely fixed with each other.

In some embodiments, the ear hook may be fixed to the circuit housing in a plug-in manner. The ear hook may be injection-molded with a housing protective sleeve, wherein the housing protective sleeve may cover a periphery of the circuit housing and the button in a sleeve manner.

In some embodiments, the housing protective sleeve may be a bag-like structure with an opening at one end, such that the circuit housing and the button may enter the inside of the housing protective sleeve through an opening end of the housing protective sleeve.

In some embodiments, the opening end of the housing protective sleeve may be disposed with a collar flange protruding inward. The end of the circuit housing away from the ear hook may be stepped/in a step shape, thereby forming a circular table. When the housing protective sleeve covers the periphery of the circuit housing, the collar flange may abut the circular table.

In some embodiments, a sealant may be applied to a connection region between the collar flange and the circular table so as to seal and connect the housing protective sleeve and the circuit housing.

In some embodiments, the loudspeaker apparatus may further include an auxiliary film including a board and a pressing foot protruding from the board. The pressing foot may be used to press the button circuit board on an inner surface of the auxiliary side wall.

In some embodiments, the main side wall of the circuit housing may include at least one mounting hole. And the loudspeaker apparatus may further include a conductive column inserted into the mounting hole. The board may include a hollow region, wherein the board may be disposed on an inner surface of the main side wall, and the mounting hole may be located inside the hollow region, such that a glue tank may be formed on a periphery of the conductive column.

In some embodiments, the hollow region may include a notch. The inner surface of the main side wall may be integrated with a striped convex rib corresponding to the notch, such that the striped convex rib and the auxiliary film may be combined to make the glue tank closed.

In some embodiments, the conductive column may include a columnar body inserted into the mounting hole. An outer peripheral surface of the columnar body may include a locating boss. The locating boss may be clamped to the main side wall, thereby fixing the conductive column to the mounting hole.

In some embodiments, the columnar body may be divided into a first columnar body and a second columnar body along an insertion direction of the columnar body with respect to the mounting hole. A cross-section of the first columnar body perpendicular to the insertion direction may be larger than a cross-section of the second columnar body perpendicular to the insertion direction. The locating boss may be placed on the second columnar body. The mounting hole may be divided into a first hole section and a second hole section with cross-sections corresponding to the first columnar body and the second columnar body along the insertion direction respectively, such that a circular table may be formed at a junction of the first hole section and the second hole section. When the columnar body is inserted into the mounting hole, the first columnar body may be supported on the circular table, and the locating boss may be clamped to the inner surface of the main side wall.

In some embodiments, the columnar body may include an accommodating chamber along an axial direction. An opening end of the accommodating chamber may be on an end surface of the second columnar body facing toward the inside of the circuit housing. And the conductive column may further include a spring and a conductive contact inside the accommodating chamber. One end of the conductive contact may abut the spring, and another end may be exposed from the opening end of the accommodating chamber. The loudspeaker apparatus may further include a main control circuit board disposed inside the circuit housing. The main control circuit board may include a contact corresponding to a position of the conductive column, and the spring may elastically press the conductive contact on the contact.

In some embodiments, a main surface of the main control circuit board may be axial vertically set respect to the conductive column.

In some embodiments, the cover may include a bracket and a cover layer injection-molded integrally on a surface of the bracket. The bracket may be used to physically connect to the accommodating body, and the cover layer may be used to seal the cavity after the bracket is connected to the accommodating body.

In some embodiments, a shape of a side of the bracket facing toward the accommodating body may match the opening so as to snap onto the opening, and the cover layer may cover an outer surface of the bracket away from the accommodating body.

In some embodiments, the bracket may include an insertion part and a cover part. The cover part may be disposed on the opening. The insertion part may be disposed on one side of the cover part and extending into the cavity along an inner wall of the cavity, so as to fix the cover part on the opening.

In some embodiments, the accommodating body may include an opening edge defining the opening. The cover part may be pressed on an inner region of the opening edge near the opening. The cover layer may cover an outer surface of the cover part away from the accommodating body, and may be pressed on an outer region outside the inner region of the opening edge, thereby sealing the cover layer and the opening edge.

In some embodiments, in a snapped state, a contact end surface between the cover part and the opening edge may be flush with a contact end surface between the cover layer and the opening edge. Or the cover layer may further extend between the cover part and the opening edge, and may be pressed on the inner region of the opening edge by the cover part.

In some embodiments, a cavity of the accommodating body may include a circuit component. The circuit component may include a switch. The bracket may include a switch hole corresponding to the switch. The cover layer may cover the switch hole and include a pressing part at a position corresponding to the switch hole. The pressing part may extend toward the inside of the cavity through the switch hole. When a corresponding position of the cover layer is pressed, the pressing part may press the switch on the circuit component, thereby triggering the circuit component to perform a preset function.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which a same number may indicate a same structure throughout the several views of the drawings, and wherein.

DETAILED DESCRIPTION

Figure 1:
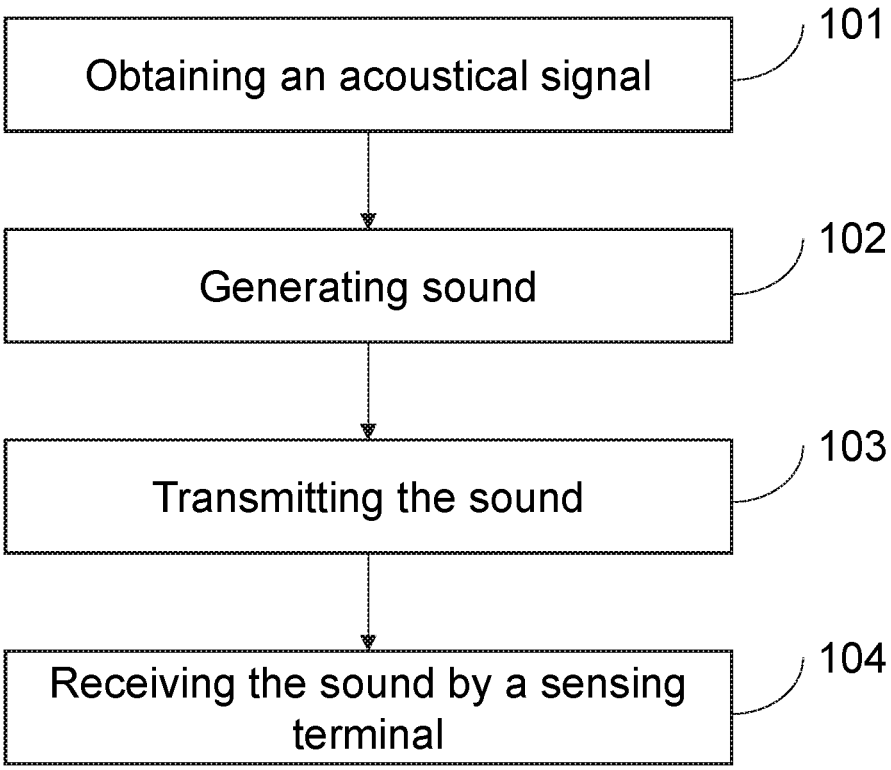
FIG. 1 is a schematic diagram illustrating a process in which a loudspeaker apparatus causes auditory senses in a human ear.

In order to illustrate the technical solutions related to the embodiments of the present disclosure, the drawings used to describe the embodiments are briefly introduced below. Obviously, the drawings described below are only some examples or embodiments of the present disclosure. Those skilled in the art may apply the present disclosure to other similar scenarios without further creative efforts according to these drawings. It should be understood that the exemplary embodiments are provided merely for better comprehension and application of the present disclosure by those skilled in the art, and not intended to limit the scope of the present disclosure. Unless obvious from the context or illustrated in the context, the same numeral in the drawings refers to the same structure or operation.

As used in the specification and the claims, the singular forms "a," "an," and "the" may include the plural forms as well, unless the context clearly indicates otherwise. In general, the terms "comprise" and "include" may merely specify the presence of stated steps, operations and elements, and these operations and elements may not constitute an exclusive listing. The method or the device may also include other operations and elements. The term "based on" refers to "based at least in part on." The term "one embodiment" refers to "at least one embodiment", the term "another embodiment" refers to "at least one other embodiment." The definitions related to other terms will be given in the following description. In the following, without loss of generality, in the description of sound conduction related technologies in the present disclosure, "player," "loudspeaker apparatus," or "loudspeaker" will be used. These terms are only one form of sound conduction application. For those skilled in the art, "player," "playing apparatus," "speaking apparatus," "loudspeaker apparatus," or "hearing aid" can also be replaced by other similar words. In fact, the various implementations in the present disclosure may be easily applied to hearing devices other than the loudspeaker. For example, for those skilled in the art, after understanding the basic principles of loudspeaker, it is possible to make various modifications and changes in the form and details of the specific methods and steps for implementing the loudspeaker without departing from this principle. In particular, an ambient sound pickup and processing function may be added to the loudspeaker apparatus, such that the loudspeaker apparatus may realize the function of a hearing aid. For example, in the case of using the bone conduction loudspeaker, by adding a sound transmission device like a microphone that may pick up ambient sound surroundings a user/wearer, the ambient sound may be processed according to a certain algorithm (or a generated electrical signal) and transmitted to the bone conduction loudspeaker. That is, the bone conduction loudspeaker may be modified to include a function of picking up the ambient sound. The ambient sound may be may be processed and transmitted to the user/wearer through the bone conduction loudspeaker after certain signal processing, thereby realizing a function of the bone conduction hearing aid. As an example, the algorithm mentioned here may include a noise cancellation, an automatic gain control, an acoustic feedback suppression, a wide dynamic range compression, an active environment recognition, an active noise reduction, a directional processing, a tinnitus processing, a multi-channel wide dynamic range compression, an active howling suppression, a volume control, or the like, or any combination thereof.

FIG. 1 is a schematic diagram illustrating a process in which a loudspeaker apparatus causes auditory senses in a human ear. The loudspeaker apparatus may transmit sound to an auditory system in a way of bone conduction or air conduction through its built-in loudspeaker, thereby generating auditory senses. As shown in FIG. 1, the process in which the loudspeaker apparatus causes auditory senses in the human ear may mainly include the following steps.

In step 101, the loudspeaker apparatus may acquire or generate a signal containing sound information. In some embodiments, the sound information may refer to a video or audio file in a specific data format, and may also refer to data or files in general that may be eventually converted into sound in a specific way. In some embodiments, the signal containing the sound information may be from a storage unit of the loudspeaker apparatus, or an information generation, storage, or transmission system other than the loudspeaker apparatus. The sound signal used herein is not limited to an electrical signal, and may also include other forms of signal, such as an optical signal, a magnetic signal, a mechanical signal, etc. In principle, as long as the signal contains information that may be used to generate sound by the loudspeaker apparatus, it may be processed as a sound signal. In some embodiments, the sound signal is not limited to one signal source, but a plurality of signal sources. The plurality of signal sources may be related or not related to each other. In some embodiments, a method for transmitting or generating a sound signal may be wired or wireless, and may be real-time or delayed. For example, the loudspeaker apparatus may receive an electrical signal containing sound information in a wired or wireless way, and may also obtain data directly from a storage medium to generate the sound signal. Taking a bone conduction technology as an example, a component with a sound collection function may be added to a bone conduction loudspeaker. The component with the sound collection function may pick up ambient sound, and convert a mechanical vibration of the ambient sound into an electrical signal. The electrical signal may be processed by an amplifier to satisfy a specific requirement. Wherein, a wired connection may include but not limited to a metal cable, an optical cable, or a hybrid cable of metal and optical, such as a coaxial cable, a communication cable, a flexible cable, a spiral cable, a nonmetallic sheathed cable, a metal-sheathed cable, a multi-core cable, a twisted pair cable, a ribbon cable, a shielded cable, a telecommunication cable, a double-stranded cable, a parallel twin-core wire, and a twisted pair. The examples described above are only for the convenience of illustration. The medium of the wired connection may also include other types, such as other electrical or optical signal transmission carriers.

A storage device/storage unit herein may include a storage device on a storage system, such as a direct-attached storage, a network-attached storage, and a storage area network, or the like. The storage device may include but is not limited to a common storage device, such as a solid-state storage device (e.g., a solid-state disk, a hybrid hard disk, etc.), a mechanical hard disk, a USB flash memory, a memory stick, a memory card (e.g., CF, SD), other drivers (e. g. CD, DVD, HD DVD, Blu-ray), a random access memory (RAM), and a read-only memory (ROM), etc. The RAM may include but is not limited to a dekatron, a selectron, a delay line memory, a Williams tube, a dynamic random access memory (DRAM), a static random access memory (SRAM), a thyristor random access memory (T-RAM), a zero capacitor random access memory (Z-RAM), etc. The ROM may include but is not limited to a bubble memory, a twistor memory, a film memory, a plated wire memory, a magnetic-core memory, a drum memory, a CD-ROM, a hard disk, a tape, a non-volatile random access memory (NVRAM), a phase-change memory, a magneto-resistive random access memory, a ferroelectric random access memory, a non-volatile SRAM, a flash memory, an electrically erasable programmable read-only memory, an erasable programmable read-only memory, a programmable read-only memory, a mask ROM, a floating gate random access memory, a Nano random access memory, a racetrack memory, a resistive random access memory, a programmable metallization unit, etc. The storage device/storage unit mentioned above is a list of examples. Storages used in the storage device/storage unit are not limited thereto.

In step 102, the loudspeaker apparatus may convert the signal containing sound information into a vibration to generate sound. The generation of vibration is accompanied by an energy conversion. The loudspeaker apparatus may use a specific transducer apparatus to convert the signal into a mechanical vibration. The energy conversion may include a coexistence and a conversion of many different types of energy. For example, an electrical signal may be directly converted into the mechanical vibration by a transducer to generate sound. In another example, the sound information may be included in an optical signal. A specific transducer may convert the optical signal into a vibration signal. Other types of energy that may coexist and be converted during an operation of the transducer may include thermal energy, magnetic field energy, or the like. In some embodiments, an energy conversion type of the transducer may include, but is not limited to, a moving-coil type, an electrostatic type, a piezoelectric type, a moving-iron type, a pneumatic type, an electromagnetic type, or the like. A frequency response range and sound quality of the loudspeaker apparatus may be affected by the different energy conversion types and performance of various physical components in the transducer. For example, in a moving-coil transducer, a wound cylindrical coil may be connected to a vibration plate. The wound cylindrical coil driven by a signal current may drive the vibration plate to generate sound in a magnetic field. An expansion and a contraction of material, a deformation of folds, a size, a shape and a fixing method of the vibration plate, a magnetic density of a permanent magnet, or the like, may greatly affect final sound quality of the loudspeaker apparatus.

It should be understood that the term "sound quality" used herein indicates the quality of the sound, which refers to fidelity of audio after processing, transmission, or the like. In a sound device, the sound quality may usually include an intensity, an amplitude, a frequency, an overtone, a harmonic component of the audio. When evaluating the sound quality, there may be both a measurement method and an evaluation criterion for objectively evaluating the sound quality, and a method for evaluating various attributes of the sound quality by combining different elements of the sound and a subjective feeling. Therefore, the generation, transmission, and receiving of the sound may affect the sound quality of the sound to a certain extent.

In step 103, the sound may be transmitted through a transmission system. In some embodiments, the transmission system may refer to a substance that transmits the vibration signal containing sound information, such as a skull, a bone labyrinth, inner ear lymph fluid, and a spiral organ of a human and/or an animal having an auditory system. As another example, the transmission system may include a medium that transmits sound (e.g., air, liquid). Merely to illustrate a process of transmitting the sound information through the transmission system, a bone conduction loudspeaker is taken as an example. The bone conduction loudspeaker may directly transmit a sound wave (a vibration signal) converted from an electrical signal through a bone to an auditory center. In addition, the sound wave may also be transmitted to the auditory center by means of air conduction. More descriptions regarding the air conduction may be found elsewhere in the present disclosure.

In step 104, the sound information may be transmitted to a sensing terminal. Specifically, the sound information may be transmitted to the sensing terminal through the transmission system. In a working scenario, the loudspeaker apparatus may pick up or generate a signal containing sound information, convert the sound information into a sound vibration by the transducer, and transmit the sound to the sensing terminal through the transmission system, finally enabling the sound to be heard. Without loss of generality, a subject having the abovementioned sensing terminal, the auditory system, a sensory organ, or the like, may be a human, or an animal with an auditory system. It should be noted that the following descriptions regarding the use of the loudspeaker apparatus by the human are not limited to a usage scenario of the loudspeaker apparatus. Similar descriptions may also be applied to other animals.

The above descriptions regarding a general process of the loudspeaker apparatus are only a specific embodiment, and should not be regarded as the only feasible implementation solution. Obviously, for those skilled in the art, after understanding a basic principle of the loudspeaker apparatus, it is possible to make multiple variations and modifications in the form and details of the specific manners and steps for implementing the loudspeaker apparatus, without departing from this principle. However, those variations and modifications do not depart from the scope of the present disclosure.

Figure 2:
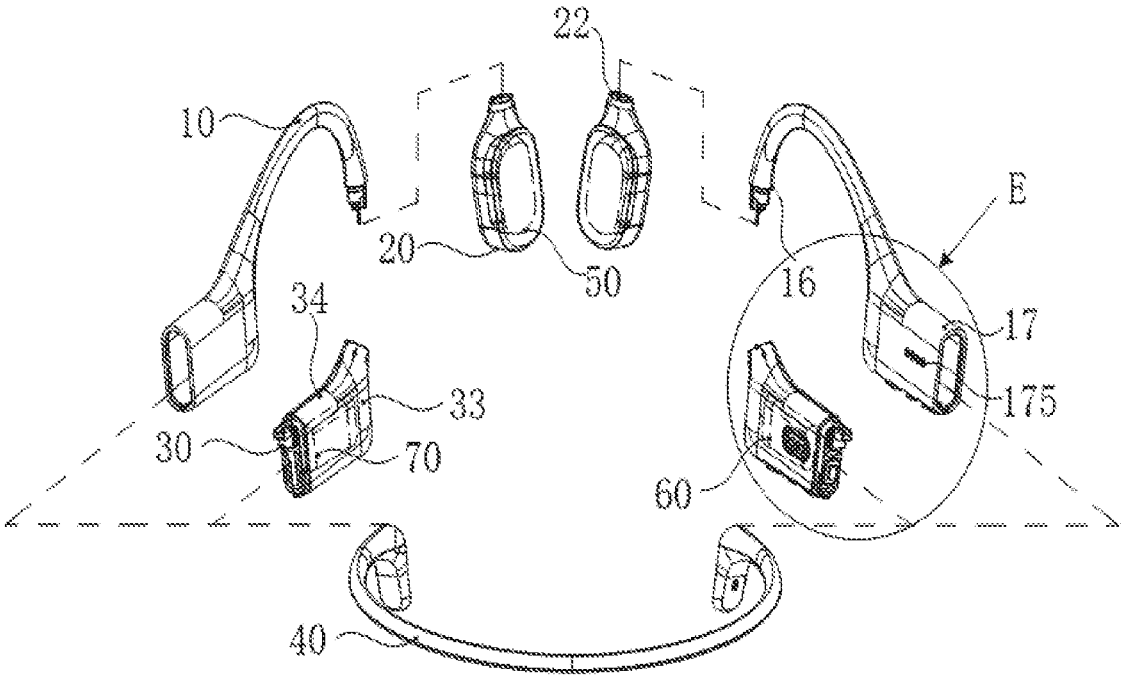
FIG. 2 is a schematic diagram illustrating the structure of a loudspeaker apparatus according to some embodiments of the present disclosure.

The loudspeaker apparatus in the present disclosure may be a headset, an MP3 player, a hearing aid, or other apparatus having a speaker function. In the following embodiments of the present disclosure, an MP3 player is taken as an example to specifically illustrate the loudspeaker apparatus. FIG. 2 is a schematic diagram illustrating an exploded view of structures of an MP3 player according to some embodiments of the present disclosure. As shown in FIG. 2, in some embodiments, the MP3 player may include an ear hook 10, an earphone core housing 20, a circuit housing 30, a rear hook 40, an earphone core 50, a control circuit 60, and a battery 70. The earphone core housing 20 and the circuit housing 30 may be placed at two ends of the ear hook 10, respectively. The rear hook 40 may be disposed at an end of the circuit housing 30 far from the ear hook 10, respectively. There may be two earphone core housings 20, which are used to accommodate the earphone core 50, respectively. There may be two circuit housings 30, which are used to accommodate the control circuit 60 and the battery 70, respectively. Two ends of the rear hook 40 may be connected to the corresponding circuit housing 30, respectively.

Figure 3:
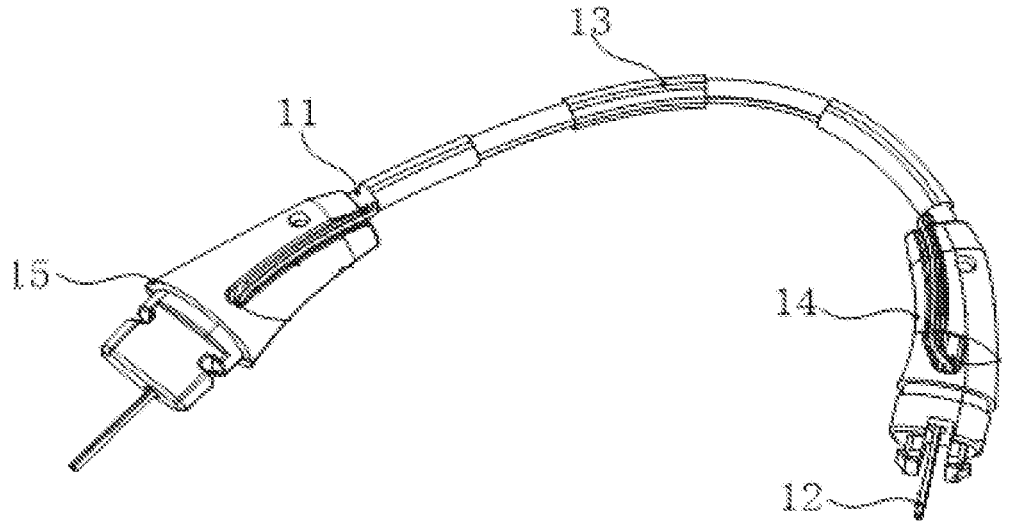
FIG. 3 is a schematic diagram illustrating a partial structure of an ear hook in an MP3 player according to some embodiments of the present disclosure.
Figure 4:
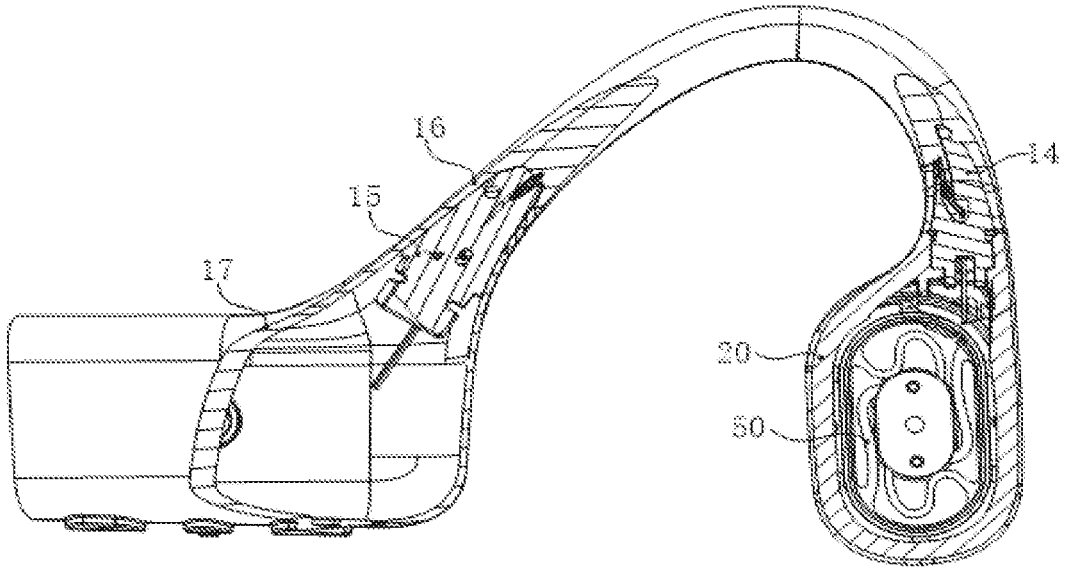
FIG. 4 is a schematic diagram illustrating a partial cross-section view of an MP3 player according to some embodiments of the present disclosure.

FIG. 3 is a schematic diagram illustrating a partial structure of an ear hook in an MP3 player according to some embodiments of the present disclosure. FIG. 4 is a schematic diagram illustrating a partial cross-section view of an MP3 player according to some embodiments of the present disclosure. According to FIGS. 2-4, in some embodiments, the ear hook 10 may include an elastic wire 11, a wire 12, a fixed sleeve 13, a plug end 14, and a plug end 15. A plug end 14, and a plug end 15 may be placed at two ends of the elastic wire 11. In some embodiments, the ear hook 10 may also include a protective sleeve 16 and a housing protective sleeve 17 integrated with the protective sleeve 16. The protective sleeve 16 may be injection-molded on a periphery of the elastic wire 11, the wire 12, the fixed sleeve 13, the plug end 14, and the plug end 15, such that the protective sleeve 16 may be connected and fixed to the elastic wire 11, the wire 12, the fixed sleeve 13, the plug end 14, and the plug end 15, respectively. In this case, there is no need to form the protective sleeve 16 separately by means of injection molding and use the protective sleeve 16 to cover the periphery of the elastic wire 11, the plug end 14, and the plug end 15, which may simplify a manufacturing and assembly process, and make the fixing of the protective sleeve 16 more reliable and stable.

In some embodiments, when the protective sleeve 16 is molded, the housing protective sleeve 17 may be integrated with the protective sleeve 16 and placed on a side close to the plug end 15. In some embodiments, the housing protective sleeve 17 may be integrated with the protective sleeve 16 as a whole. The circuit housing 30 may be connected to one end of the ear hook 10 via a plug connection with the plug end 15. A jack 22 of the earphone core housing 20 may be connected to the other end of the ear hook 10 via a plug connection with the plug end 14. The housing protective sleeve 17 may cover a periphery of the circuit housing 30 in a sleeve manner. In some embodiments, the protective sleeve 16 and the housing protective sleeve 17 may be made of a soft material having a certain elasticity, such as soft silicone, rubber, or the like. In some embodiments, the housing protective sleeve 17 may be a bag-like structure with an opening at one end, such that the circuit housing 30 may enter the inside of the housing protective sleeve 17 through an opening end of the housing protective sleeve 17. Specifically, the opening end of the housing protective sleeve 17 may be an end of the housing protective sleeve 17 away from the protective sleeve 16, such that the circuit housing 30 may enter the inside of the housing protective sleeve 17 from an end of the housing protective sleeve 17 away from the protective sleeve 16, so as to be covered by the housing protective sleeve 17.

Figure 5:
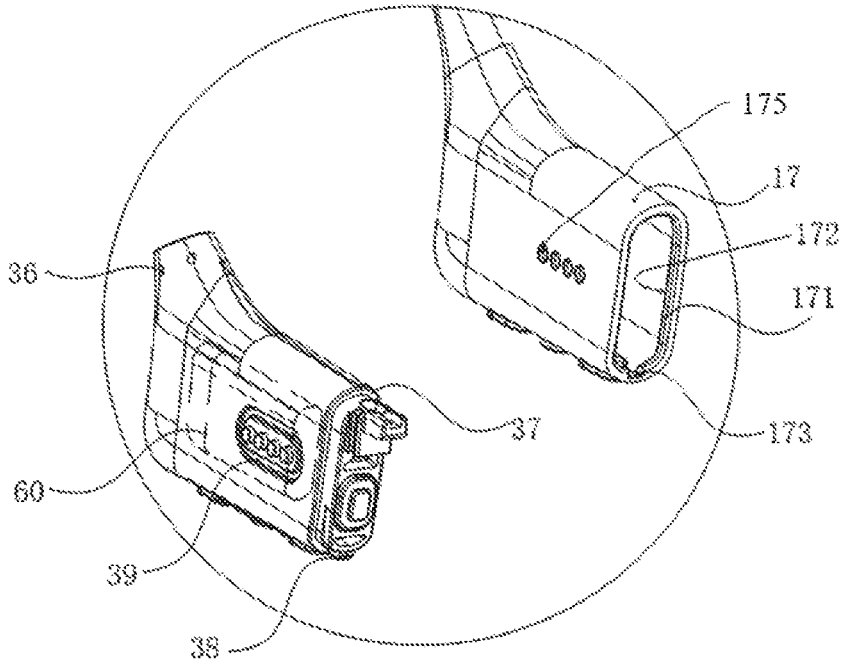
FIG. 5 is a schematic diagram illustrating a partially enlarged view of a part E in FIG. 2 according to some embodiments of the present disclosure.

FIG. 5 is a schematic diagram illustrating a partially enlarged view of a part E in FIG. 2 according to some embodiments of the present disclosure. According to FIG. 2 and FIG. 5, the opening end of the housing protective sleeve 17 may be disposed with a collar flange 171 protruding inward. An end of the circuit housing 30 away from the ear hook 10 may be stepped/in a step shape, thereby forming a circular table 37. When the housing protective sleeve 17 covers the periphery of the circuit housing 30, the collar flange 171 may abut the circular table 37. An inner wall surface of the opening end of the housing protective sleeve 17 may protrude toward the inside of the housing protective sleeve 17 with a certain thickness to form the collar flange 171. The collar flange 171 may include a flange surface 172 facing toward the ear hook 10. The circular table 37 may be opposite to the flange surface 172, and face a direction of the circuit housing 30 away from the ear hook 10. A height of the flange surface 172 of the collar flange 171 may be not greater than a height of the circular table 37, such that when the flange surface 172 of the collar flange 171 abuts the circular table 37, the inner wall surface of the housing protective sleeve 17 may fully abut a sidewall surface of the circuit housing 30. In this way, the housing protective sleeve 17 may tightly cover the periphery of the circuit housing 30. In some embodiments, a sealant may be applied to a connection region between the collar flange 171 and the circular table 37. Specifically, when sleeving the housing protective sleeve 17, the sealant may be applied on the circular table 37, thereby sealing and connecting the housing protective sleeve 17 and the circuit housing 30.

In some embodiments, the circuit housing 30 may further include a locating block 38. The locating block 38 may be placed on the circular table 37, and extend along a direction of the circuit housing 30 away from the ear hook 10. Specifically, the locating block 38 may be placed on an auxiliary side wall 34 of the circuit housing 30, and a protrusion thickness of the locating block 38 on the auxiliary side wall 34 may be consistent with the height of the circular table 37. One or more locating blocks 38 may be provided according to needs. Correspondingly, the collar flange 171 of the housing protective sleeve 17 may include a locating groove 173 corresponding to the locating block 38, such that when the housing protective sleeve 17 covers the periphery of the circuit housing 30, the locating groove 173 covers at least part of the locating block 38.

Figure 6:
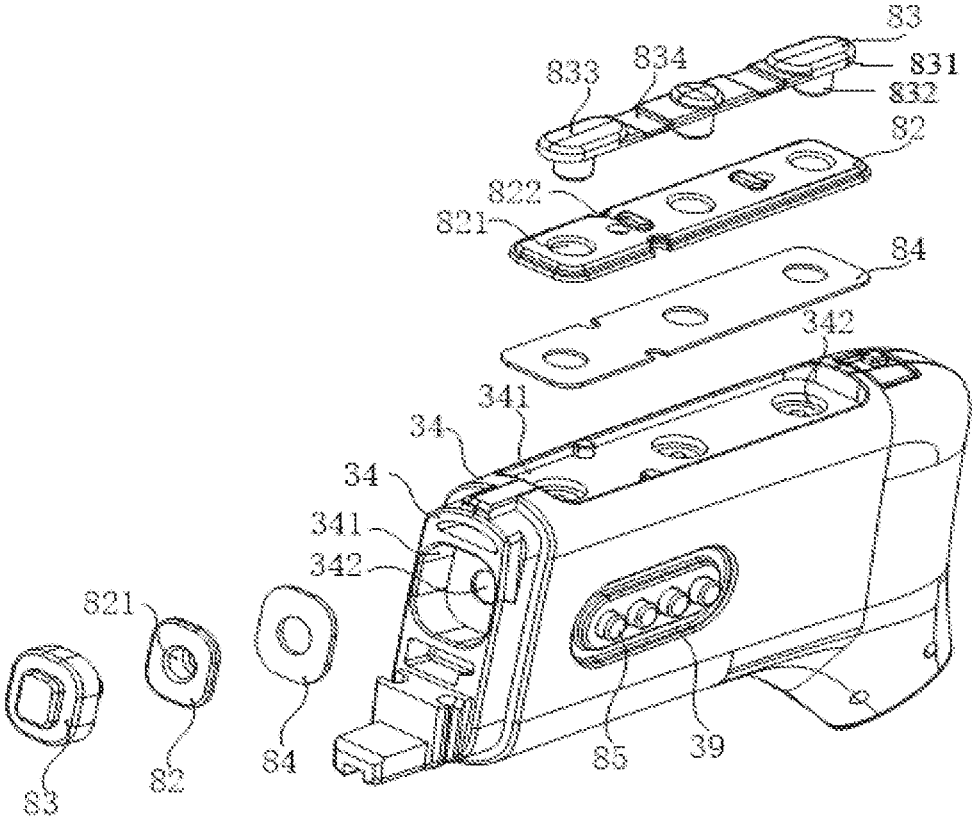
FIG. 6 is a schematic diagram illustrating an exploded view of a circuit housing and a button mechanism according to some embodiments of the present disclosure.
Figure 7:
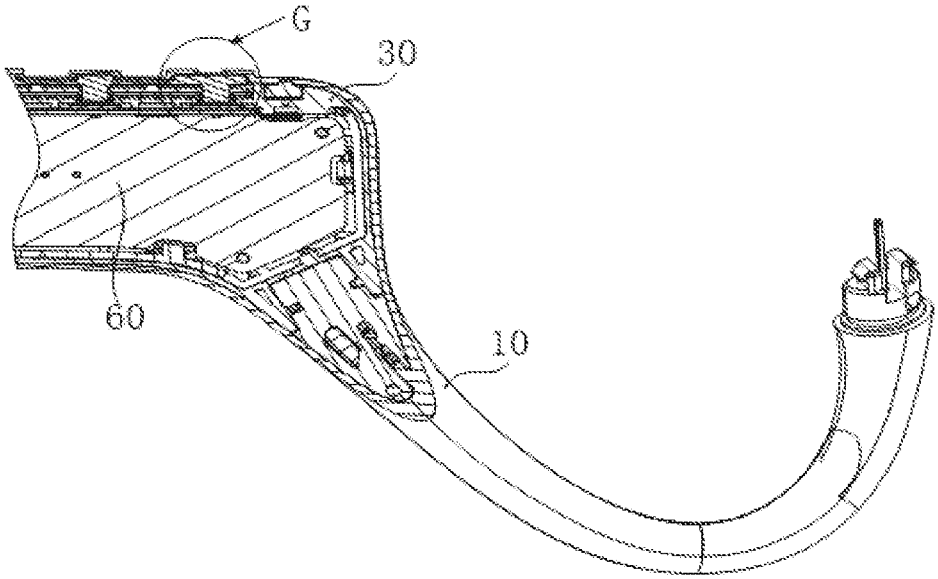
FIG. 7 is a schematic diagram illustrating partial cross-section views of a circuit housing, a button mechanism, and an ear hook according to some embodiments of the present disclosure.
Figure 8:
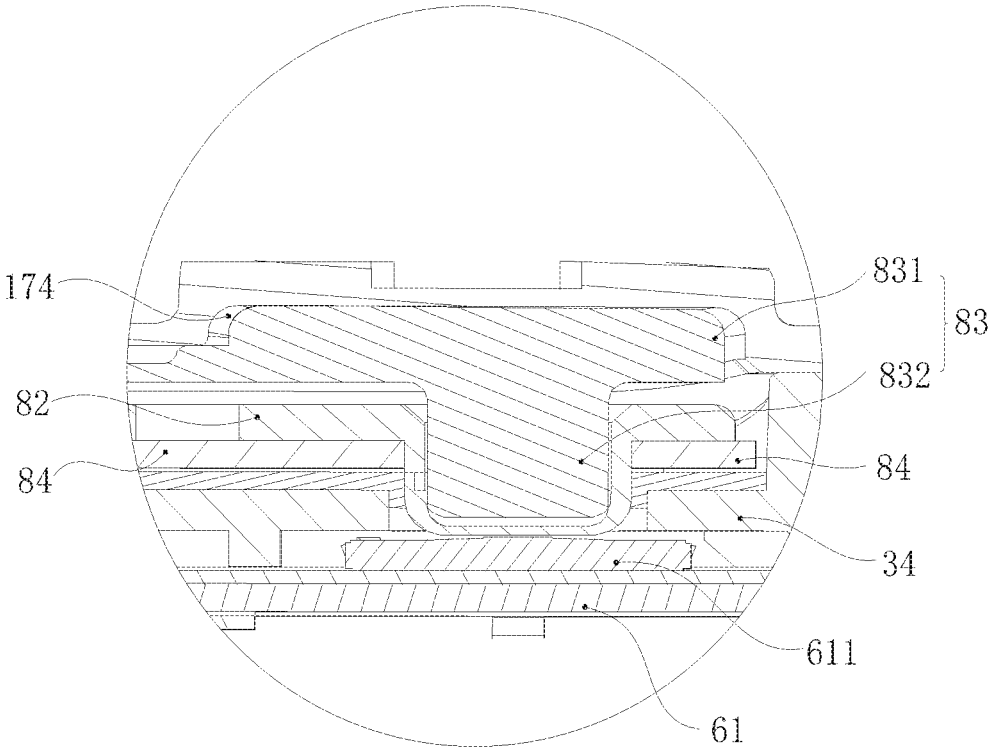
FIG. 8 is a schematic diagram illustrating a partially enlarged view of a part G in FIG. 7 according to some embodiments of the present disclosure.

FIG. 6 is a schematic diagram illustrating an exploded view of a circuit housing and a button mechanism according to some embodiments of the present disclosure. FIG. 7 is a schematic diagram illustrating partial cross-section views of a circuit housing, a button mechanism, and an ear hook according to some embodiments of the present disclosure. FIG. 8 is a schematic diagram illustrating a partially enlarged view of a part G in FIG. 7 according to some embodiments of the present disclosure. According to FIG. 2, and FIGS. 6-8, in some embodiments, the MP3 player may further include the button mechanism. In this embodiment, circuit housing 30 may be flat. Two opposite sidewalls of the circuit housing 30 with larger areas may be main side walls 33, and two opposite sidewalls with smaller areas that connect the two main side wall 33 may be auxiliary side walls 34. An outer surface of an auxiliary side wall 34 of the circuit housing 30 may include a first recess region 341. The first recess region 341 may include a button hole 342 connecting the outer surface and an inner surface of the auxiliary side wall 34. The auxiliary side walls 34 of the circuit housing 30 may include an auxiliary side wall 34 facing toward a rear side of a user's head when the user wears the MP3 player, and may also include an auxiliary side wall 34 facing toward a lower side of the user's head when the user wears the MP3 player. There may be one or more first recess regions 341 each of which may include one or more button holes 342. A count of the button holes 342 may be determined according to actual needs, and is not specifically limited here.

In some embodiments, the MP3 player may further include an elastic pad 82 and a button 83, and the control circuit 60 may include a button circuit board 61. The elastic pad 82 may be placed in the first recess region 341, and may be specifically fixed on an outer surface of an auxiliary side wall 34 corresponding to the first recess region 341, so as to cover a periphery of the button hole 342, and prevent external liquid from entering the inside of the circuit housing 30 through the button hole 342, thereby playing a role of sealing and waterproofing. In some embodiments, the elastic pad 82 may include a second recess region 821 corresponding to the button hole 342, and the second recess region 821 may extend into the button hole 342. In some embodiments, the elastic pad 82 may be made of a soft material, such as soft silicone or rubber. In addition, the elastic pad 82 may be relatively thin, which makes it difficult to bond the elastic pad 82 firmly to the outer surface of the auxiliary side wall 34 when directly bonding the elastic pad 82 to the outer surface of the auxiliary side wall 34. Since the elastic pad 82 is placed between the button 83 and the button hole 342, when a user presses the button, the elastic pad 82 may generate a force opposite to a pressing direction due to its deformation, which hinders a movement of the button relative to the button hole 342.

In some embodiments, a rigid pad 84 may be disposed between the elastic pad 82 and the circuit housing 30. The rigid pad 84 and the elastic pad 82 may be closely fixed with each other, specifically, by means of lamination, bonding, injection molding, etc. Further, the rigid pad 84 may be bonded to the auxiliary side wall 34, specifically, by using a double-sided adhesive, so as to form an adhesive layer between the rigid pad 84 and the auxiliary side wall 34. In this way, the elastic pad 82 may be firmly fixed on the outer surface of the auxiliary side wall 34. Moreover, since the elastic pad 82 is soft and thin, it may be difficult for the elastic pad 82 to maintain a flat state when a user presses the button. By closely fixing with the rigid pad 84, the elastic pad 82 may maintain flat.

In some embodiments, the rigid pad 84 may include a through hole 841 that allows the second recess region 821 to pass through, such that the second recess region 821 of the elastic pad 82 may further extend into the button hole 342 through the through hole 841. In some embodiments, the rigid pad 84 may be made of stainless steel, or other steel materials, such as a hard material like plastic. The rigid pad 84 may be closely fixed with the elastic pad 82 by means of one-piece molding.

In some embodiments, the button 83 may include a button body 831 and a button contact 832 protruding from one side of the button body 831. The button body 831 may be placed on a side of the elastic pad 82 away from the circuit housing 30, and the button contact 832 may extend into the second recess region 821 to extend into the button hole 342 along with the second recess region 821. Since the MP3 player in this embodiment is relatively thin and light, a pressing stroke of the button 83 may be short. If a soft button is used, the user's pressing feeling may be affected, thereby resulting in a bad experience. In this embodiment, the button 83 may be made of hard plastic material, such that the user may have a good feeling when pressing the button 83.

The button circuit board 61 may be placed inside the circuit housing 30. The button circuit board 61 may include a button switch 611 corresponding to the button hole 342. Thus, when the user presses the button 83, the button contact 832 may contact and trigger the button switch 611 to further implement a corresponding function.

In this embodiment, the second recess region 821 may be disposed on the elastic pad 82. In this way, on the one hand, the second recess region 821 may cover the entire button hole 342, which improves a waterproof effect at the same time; on the other hand, in a natural state, the button contact 832 may extend into the button hole 342 through the second recess region 821, which shortens the pressing stroke of the button 83 to reduce a space occupied by the button structure. Thus, the MP3 player may not only have good waterproof performance, but also take up less space.

In some embodiments, the button 83 may include a button monomer 833, and there may be one or more button monomers 833. In an application scenario, the button 83 may include at least two button monomers 833 spaced from each other and a connecting part 834 for connecting the button monomers 833. A plurality of button monomers 833 may be integrated with the connecting part 834. Correspondingly, each button monomer 833 may be provided with one button contact 832, and further correspond to a button hole 342 and a button switch 611. Each first recess region 341 may include a plurality of button monomers 833, and the user may trigger different button switches 611 by pressing different button monomers 833, and then realize multiple functions.

In some embodiments, the elastic pad 82 may include an elastic convex 822 for supporting the connecting part 834. Since the button 83 may include the plurality of button monomers 833 connected to each other, the elastic convex 822 may enable one of the button monomer 833 to be pressed separately when the user presses the corresponding button monomer 833, thereby avoiding that other button monomers 833 are pressed due to a linkage between the plurality of button monomers 833. In this way, the corresponding button switch 611 may be triggered accurately. It should be noted that the elastic convex 822 is not necessary. For example, the elastic convex 822 may be a protruding structure without elasticity, or the protruding structure may be removed. The elastic convex 822 may be set according to actual conditions. In some embodiments, the inner wall of the housing protective sleeve 17 may include a concave 174 corresponding to the button 83, such that the periphery of the circuit housing 30 and the button 83, may be covered in a sleeve manner.

Figure 9:
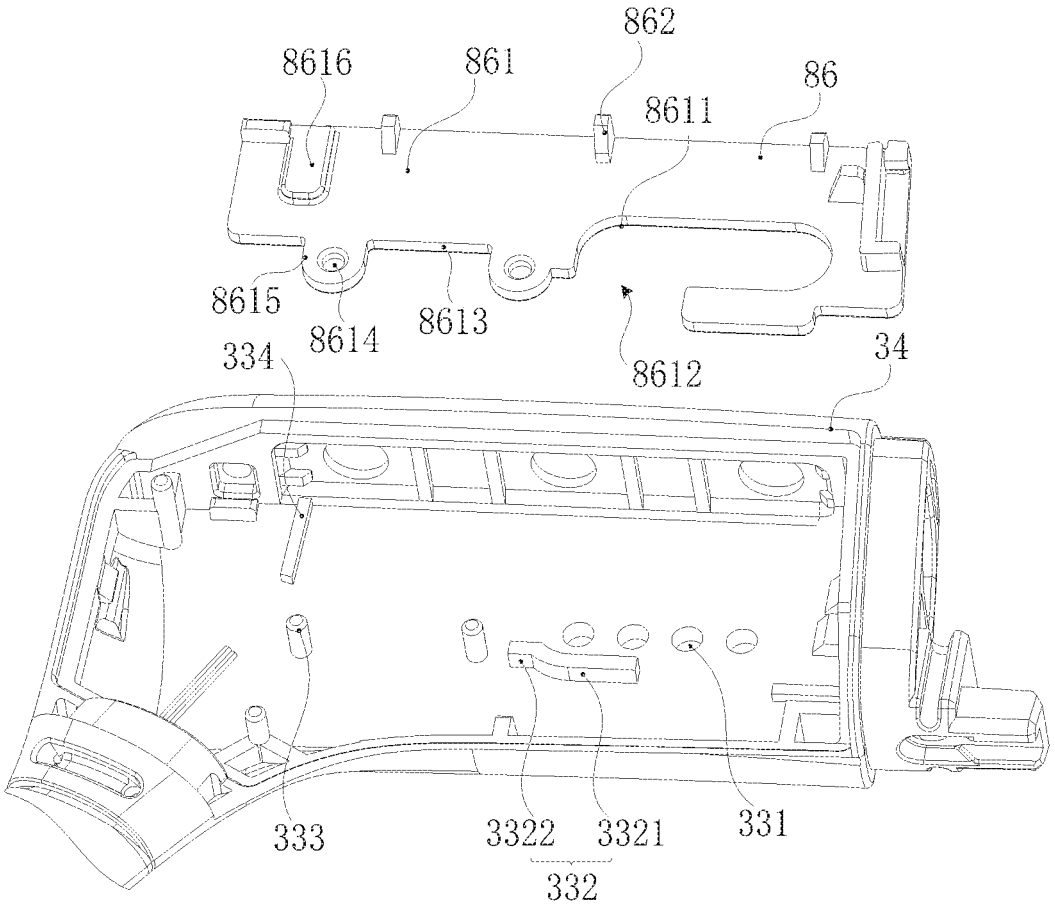
FIG. 9 is a schematic diagram illustrating an exploded view of partial structures of a circuit housing and an auxiliary film according to some embodiments of the present disclosure.
Figure 10:
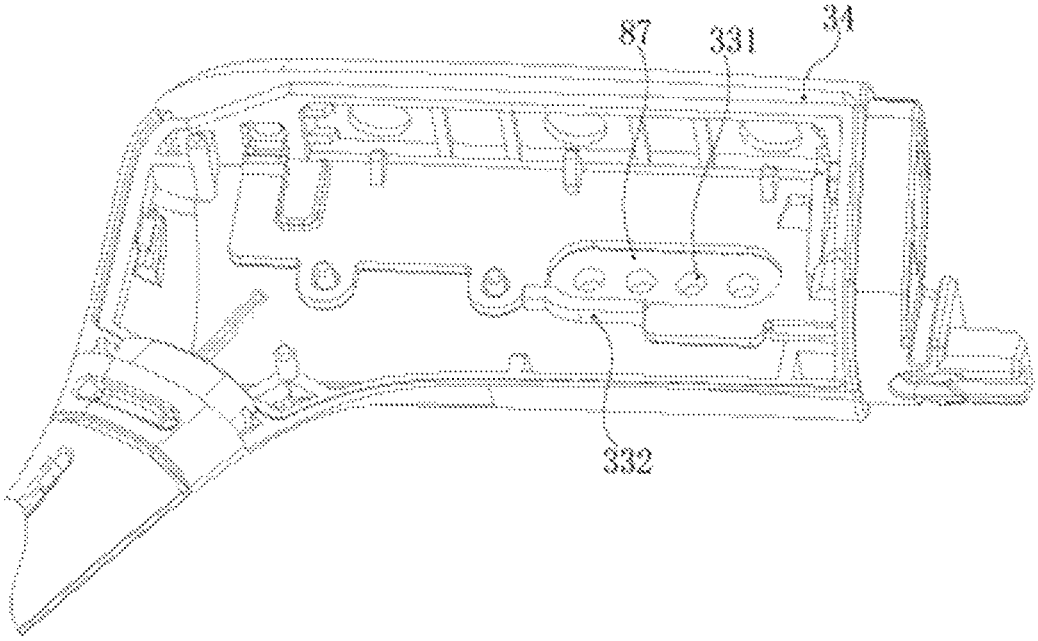
FIG. 10 is a schematic diagram illustrating partial structures of a circuit housing and an auxiliary film according to some embodiments of the present disclosure.

FIG. 9 is a schematic diagram illustrating an exploded view of partial structures of a circuit housing and an auxiliary film according to some embodiments of the present disclosure. FIG. 10 is a schematic diagram illustrating partial structures of a circuit housing and an auxiliary film according to some embodiments of the present disclosure. According to FIG. 2, FIG. 9, and FIG. 10, in some embodiments, the MP3 player may further include an auxiliary film 86 located inside the circuit housing 30. The auxiliary film 86 may include a board 861. The board 861 may include a hollow region 8611. The board 861 may be disposed on an inner surface of the main side wall 33 by means of hot melting or hot pressing, bonding, etc. The mounting hole 331 on the main side wall 33 may be located inside the hollow region 8611. Specifically, a board surface of the board 861 may abut against the inner surface of the main side wall 33 in parallel. The auxiliary film 86 may have a certain thickness. After the auxiliary film 86 is placed on the inner surface of the main side wall 33, an inner sidewall of the hollow region 8611 of the auxiliary film 86 and the main side wall 33 may form a glue tank 87 located on a periphery of a conductive column 85 inserted in the mounting hole 331.

In some embodiments, a sealant may be applied in the glue tank 87, such that mounting hole 331 may be sealed from the inside of circuit housing 30 to improve the tightness of the circuit housing 30, thereby improving the waterproof performance of the bone conduction MP3 player.

In some embodiments, a material of the auxiliary film 86 may be the same as that of the circuit housing 30, and may be formed separately from the circuit housing 30. It should be noted that, during a molding stage of the circuit housing 30, there may be other structures near the mounting hole 331, such as the button hole 342 to be molded, etc. Molds corresponding to these structures during molding may need to be withdrawn from the inside of the circuit housing 30. At this time, if the glue tank 87 corresponding to the mounting hole 331 is integrated directly inside the circuit housing 30, a convex of the glue tank 87 may hinder a smooth withdrawal of the molds corresponding to these structures, thereby causing inconvenience to production. In this embodiment, the auxiliary film 86 and the circuit housing 30 may be independent structures. After forming the two structures separately, the auxiliary film 86 may be installed inside the circuit housing 30 to form the glue tank 87 together with the main side wall 33 of the circuit housing 30. In this way, during the molding stage of circuit housing 30, the molds of a portion of the structures may not be hindered from withdrawing from the inside of the circuit housing 30, which may be beneficial to smooth production.

In some embodiments, when molding the circuit housing 30, the withdrawal of the molds may only take up part of the space occupied by the glue tank 87. Without affecting the withdrawal of the molds, part of the glue tank 87 may be integrated on an inner surface of the main side wall 33, and the other part of the glue tank 87 may still be formed by the auxiliary film 86.

In some embodiments, the inner surface of the main side wall 33 may be integrated with a first striped convex rib 332. A location of the first striped convex rib 332 may not affect the withdrawal of the mold of the circuit housing 30. The hollow region 8611 of the auxiliary film 86 may include a notch 8612. The first striped convex rib 332 may correspond to the notch 8612. After the circuit housing 30 and the auxiliary film 86 are formed respectively, the auxiliary film 86 may be placed on the inner surface of the main side wall 33, such that the first striped convex rib 332 may be at least partially fitted to the notch 8612. And the first striped convex rib 332 and the auxiliary film 86 may be combined to make the glue tank 87 closed.

In this embodiment, since the first striped convex rib 332 does not hinder the withdrawal of the mold, a sidewall of the glue tank 87 may be formed by the first striped convex rib 332 and auxiliary film 86. The first striped convex rib 332 may be integrally formed on the inner surface of the main side wall 33.

In some embodiments, the first striped convex rib 332 may further extend to abut against a side edge 8613 of the board 861, thereby locating the board 861. The first striped convex rib 332 may include a rib body 3321 and a locating arm 3322. The rib body 3321 may be used to match with and fit with the notch 8612 of the hollow region 8611, thereby forming a sidewall of the glue tank 87. The locating arm 3322 may be formed by a further extension of one end of the rib body 3321, and may extend to a side edge 8613 of the board 861 to abut against the side edge 8613, such that the board 861 may be located at the side edge 8613.

In some embodiments, a protrusion height of the first striped convex rib 332 on the inner surface of the main side wall 33 may be greater than, smaller than, or equal to a thickness of the auxiliary film 86, as long as it can form the glue tank 87 together with the auxiliary film 86, and position the board 861 of the auxiliary film 86. The protrusion height of the first striped convex rib 332 will not be specifically limited herein.

In some embodiments, the board 861 may include a locating hole 8614, and the locating hole 8614 may penetrate through a main board surface of the board 861. The inner surface of the main side wall 33 may be integrated with a locating post 333 corresponding to the locating hole 8614. After the auxiliary film 86 is placed on the inner surface of the main side wall 33, the locating post 333 may be inserted into the locating hole 8614, thereby further locating the auxiliary film 86. A count of the locating holes 8614 may be equal to a count of the locating posts 333. In this embodiment, the counts of both may be two.

In an application scenario, at least two lugs 8615 may be formed on a side edge 8613 of the board 861, and two locating holes 8614 may be placed on corresponding lugs 8615, respectively. The inner surface of the main side wall 33 may be integrated with a second striped convex rib 334. The second striped convex rib 334 may extend in a direction toward the auxiliary side wall 34, and may be perpendicular to an extending direction of the locating arm 3322 of the first striped convex rib 332. The board 861 may also include a bar-shaped locating groove 8616 corresponding to the second striped convex rib 334. The bar-shaped locating groove 8616 may be recessed along a direction away from the main side wall 33, and one end of the bar-shaped locating groove 8616 may be connected to the side edge 8613 of the board 861 and may be perpendicular to the side edge 8613.

In an application scenario, the bar-shaped locating groove 8616 may be formed only by a recession of a surface of the board 861 that abuts against the main side wall 33. A depth of the bar-shaped locating groove 8616 may be less than the thickness of the board 861. In such cases, a surface of the board 861 opposite to the recessed surface of the board 861 may not be affected by the bar-shaped locating groove 8616. In another application scenario, the depth of the bar-shaped locating groove 8616 may be greater than the depth of the board 861, such that when a surface of the board 861 closed to the main side wall 33 is recessed, the other opposite surface of the board 861 may protrude toward a recessed direction, thereby forming the bar-shaped locating groove 8616. After the auxiliary film 86 is placed on the inner surface of the main side wall 33, the second striped convex rib 334 may be embedded in the bar-shaped locating groove 8616 to further position the board 861.

According to FIG. 2, FIG. 5 and FIG. 6, in some embodiments, the housing protective sleeve 17 may include an exposed hole 175 corresponding to the conductive column 85. After the housing protective sleeve 17 over the periphery of the circuit housing 30, one end of the conductive column 85 located outside the circuit housing 30 may be exposed through the exposed hole 175, and then connected to an external circuit of the MP3 player, such that the MP3 player may provide power supply or data transmission through the conductive column 85.

In some embodiments, the outer surface of the circuit housing 30 may be recessed with a glue tank 39 surrounding a plurality of mounting holes 331. Specifically, the glue tank 39 may be in a shape of an oval ring. The plurality of mounting holes 331 may be respectively placed on the circuit housing 30 surrounded by the oval ring glue tank 39.

A sealant may be applied to the glue tank 39. After the housing protective sleeve 17 and the circuit housing 30 are assembled, the housing protective sleeve 17 may be sealed and connected to the circuit housing 30 on a periphery of the mounting hole 331 via the sealant. In this way, when external liquid enters the inside of the housing protective sleeve 17 through the exposed hole 175, the housing protective sleeve 17 may be protected from sliding around the periphery of the circuit housing 30, and the mounting hole 331 may be further sealed from the outside of the circuit housing 30, which may further improve the tightness of circuit housing 30, thereby improving the waterproof performance of the MP3 player.

It should be noted that the above descriptions regarding the MP3 player are only embodiments, and should not be considered as the only feasible implementation solution. Obviously, for those skilled in the art, after understanding the basic principle of an MP3 player, multiple variations and modifications may be made in the form and details of the specific manners and steps for implementing the loudspeaker apparatus, without departing from this principle. However, those variations and modifications do not depart from the scope of the present disclosure. For example, there may be one or more first recess regions 341. One or more button holes 342 may be correspondingly provided for each of the first recess regions 341, which is not limited herein. All these variations are within the scope of the present disclosure.

Figure 11:
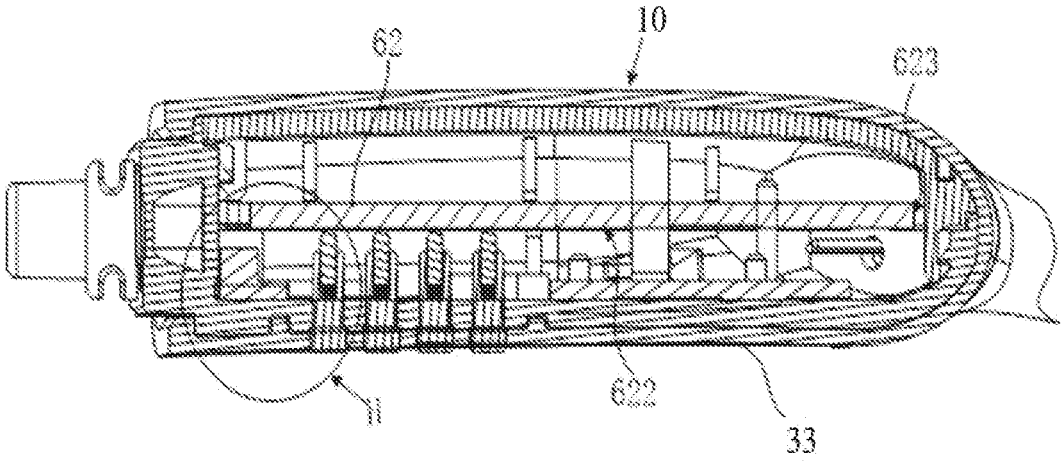
FIG. 11 is a schematic diagram illustrating cross-section views of a circuit housing, a conductive column, and a main control circuit board according to some embodiments of the present disclosure.
Figure 12:
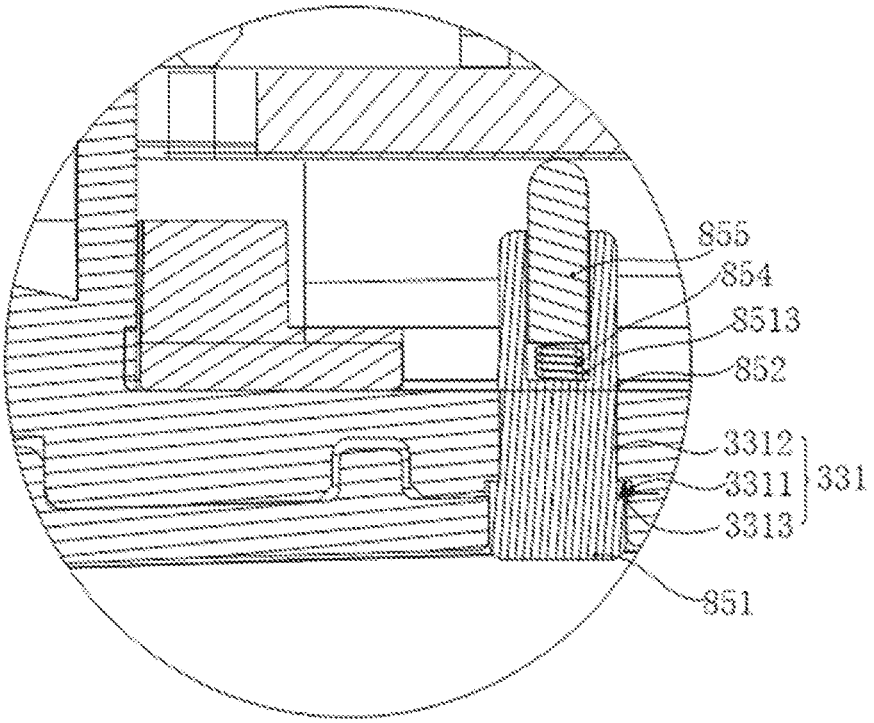
FIG. 12 is a schematic diagram illustrating a partially enlarged view of part H in FIG. 11 according to some embodiments of the present disclosure.
Figure 13:
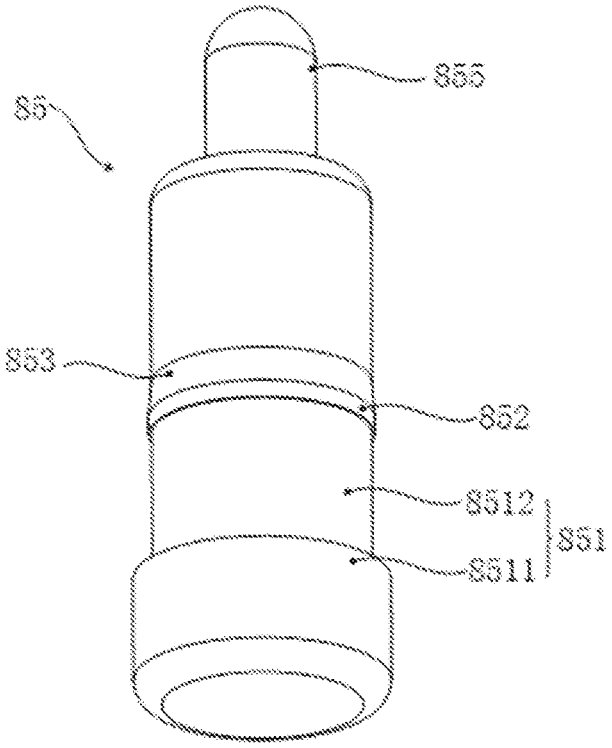
FIG. 13 is a schematic diagram illustrating the structure of a conductive column according to some embodiments of the present disclosure.

FIG. 11 is a schematic diagram illustrating cross-section views of the circuit housing 30, a conductive column 85, and a main control circuit board 62 according to some embodiments of the present disclosure. FIG. 12 is a schematic diagram illustrating a partially enlarged view of part H in FIG. 11. FIG. 13 is a schematic diagram illustrating the conductive column 85 according to some embodiments of the present disclosure.

As shown in FIG. 11, in some embodiments, the MP3 player may further include at least one conductive column 85. The control circuit accommodated inside the circuit housing 30 may include a main control circuit board 62. The conductive column 85 may be used to connect the main control circuit board 62 inside the circuit housing 30, a charging circuit and/or a data transmission line outside the circuit housing 30, so as to charge and/or communicate data with the MP3 player.

According to FIGS. 11-13, in some embodiments, the main side wall 33 of the circuit housing 30 may include at least one mounting hole 331, and the conductive column 85 may be inserted into the corresponding mounting hole 331. The conductive column 85 may correspond to the mounting hole 331 one to one. In this embodiment, there may be four conductive columns 85 and four mounting holes 331. The four conductive columns 85 may be respectively inserted into the corresponding mounting holes 331, and may be arranged side by side in a straight line at even intervals. Two conductive columns 85 located at outer sides may be used as charging interfaces, and two conductive columns 85 located in the middle may be used as data transmission interfaces.

In some embodiments, the conductive column 85 may include a columnar body 851 inserted into a mounting hole 331. In some embodiments, an outer peripheral surface of the columnar body 851 may include a locating boss 852. The locating boss 852 may be clamped to the inner surface of the main side wall 33, thereby fixing the conductive column 85 to the mounting hole 331. Specifically, the locating boss 852 may be arranged in a circle circumferentially around the columnar body 851. A side of the annular locating boss 852 facing toward the inside of the circuit housing 30 may include an extended slope 853 connecting an outer peripheral surface of the columnar body 851 and the locating boss 852. When installing the conductive column 85, the conductive column 85 may be gradually inserted into the mounting hole 331 from the outside of the circuit housing 30 along the extended slope 853, enter into the interior of the circuit housing 30, and further pass the locating boss 852. After the locating boss 852 completely passes through the mounting hole 331, a surface of the locating boss 852 facing toward the outside of the circuit housing 30 may be clamped to the inner surface of the main side wall 33, such that the conductive column 85 may be fixed in the mounting hole 331.

In the embodiment, in the assembly process assembled, the locating boss 852 may enable the conductive column 85 to be inserted into the mounting hole 331 from the outer surface of the main side wall 33 of the circuit housing 30, and the locating boss 852 may be pressed into the mounting hole 331 by being pressed. Thus, the locating boss 852 may be clamped to the inner surface of the main side wall 33 of the circuit housing 30, which eliminates the need to install the conductive column 85 from the inside of the circuit housing 30, thereby making the assembly of the MP3 player more convenient and improving production assembly efficiency. Further, in the assembly process, the extended slope 853 may enable the locating boss 852 to pass through the mounting hole 331 more smoothly. When the conductive column 85 enters the mounting hole 331, the locating boss 852 may enable the conductive column 85 to be clamped to the inner surface of the main side wall 33, and may not be easily drawn out from the conductive hole, thereby fixing the conductive column 85 firmly in the mounting hole 331.

In some embodiments, the columnar body 851 may be divided into a first columnar body 8511 and a second columnar body 8512 along an insertion direction of the columnar body 851 with respect to the mounting hole 331. The first column body and the second column body may be integrally made of a conductive metal material such as copper, silver, or an alloy into an integrated structure. In the insertion direction of the mounting hole 331 perpendicular to the conductive column 85, a cross-section of the first columnar body 8511 may be larger than a cross-section of the second columnar body 8512. The locating boss 852 may be placed on the second columnar body 8512.

In some embodiments, the mounting hole 331 may be divided into a first hole section 3311 and a second hole section 3312 with cross sections corresponding to the first columnar body 8511 and the second columnar body 8512 along the insertion direction. Further, a circular table 3313 may be formed at the junction of the first hole section 3311 and the second hole section 3312. The circular table 3313 may contact with the outer surface of the main side wall 33. When the columnar body 851 is inserted into the mounting hole 331, a side of the first columnar body 8511 facing toward the second columnar body 8512 may be supported on the circular table 3313. At the same time, a side of the locating boss 852 on the peripheral surface of the second columnar body 8512 facing toward the first columnar body 8511 may be clamped to the inner surface of the main side wall 33. Further, the conductive column 85 may be simultaneously clamped to the inner and outer sides of the main side wall 33 around the mounting hole 331, thereby fixing the conductive column 85 in the mounting hole 331.

In some embodiments, the columnar body 851 may include an accommodating chamber 8513 along an axial direction, and an opening end of the accommodating chamber 8513 may be on an end surface of the second columnar body 8512 facing toward the inside of the circuit housing 30. In some embodiments, the accommodating chamber 8513 may pass through a portion of the second columnar body 8512 located on the inner side of the circuit housing 30 along a direction parallel to the insertion direction, and terminate before reaching the locating boss 852. In other embodiments, a location of the accommodating chamber 8513 may be determined according to needs.

In some embodiments, the conductive column 85 may also include a spring 854 and a conductive contact 855 placed in the accommodating chamber 8513. One end of the conductive contact 855 may be in contact with the spring 854 inside the accommodating chamber 8513, and the other end may be exposed from the opening end of the accommodating chamber 8513 inside the circuit housing 30. In some embodiments, the material of conductive contact 855 may be the same as that of the columnar body 851. The spring 854 may be connected to the second columnar body 8512 and the conductive contact 855 by means such as bonding, welding, etc. Or the spring 854 may also be placed directly inside the accommodating chamber 8513, and elastically clamped inside the accommodating chamber 8513, by an engagement between the columnar body 851 and the main side wall 33 of the circuit housing 30, and the abutting of the conductive contact 855 and the main control circuit board 62.

In some embodiments, the main control circuit board 62 inside the circuit housing 30 may include a contact corresponding to a position of the conductive column 85. In some embodiments, the main control circuit board 62 may include a main surface 622 with a larger area and a side surface 623 with a smaller area connecting the main surface 622. The main surface 622 of the main control circuit board 62 may be parallel or approximately parallel to the main side wall 33 of the circuit housing 30, and the contact may correspond to the main surface 622 of the main control circuit board 62.

The insertion direction of the conductive column 85 into the mounting hole 331 may be parallel to the axial direction of the conductive column 85, perpendicular to the main side wall 33, and then perpendicular to the main surface 622 of the main control circuit board 62. After mounting the conductive column 85 in the mounting hole 331, the spring 854 may be clamped by the conductive contact 855 and the columnar body 851 to produce elastic deformation, so as to elastically press the conductive contact 855 on the corresponding contact, thereby achieving an electrical connection between the conductive column 85 and the main control circuit board 62.

It should be noted that the above description regarding the MP3 player is only a specific example and should not be considered as the only feasible implementation solution. Obviously, for those skilled in the art, after understanding the basic principles of MP3 players, multiple variations and modifications may be made in the form and details of the specific manners and steps for implementing the loudspeaker apparatus, without departing from this principle. However, those variations and modifications do not depart from the scope of the present disclosure. For example, the conductive column 85 and the mounting hole 311 may be not limited to the horizontal distribution shown in the figures, but may also be arranged according to other arrangements, such as a vertical arrangement, a matrix arrangement, a circular arrangement, or the like, or an irregular arrangement. All such variations are within the protection scope of the present disclosure.

Figure 14:
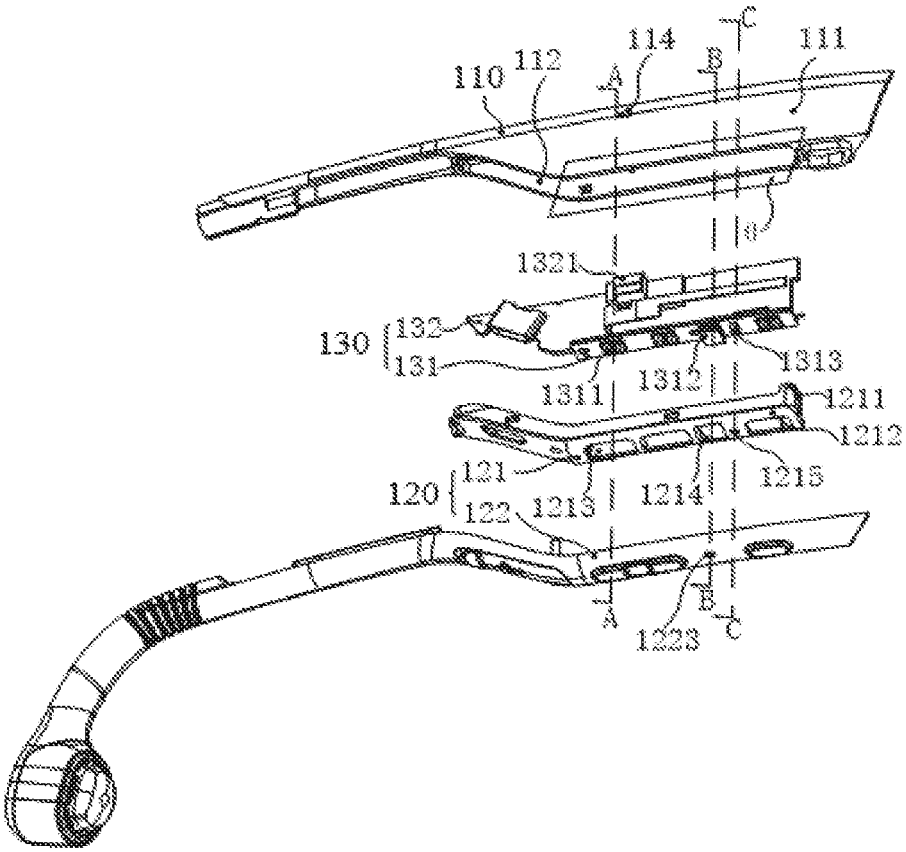
FIG. 14 is a schematic diagram illustrating an exploded view of structures of an electronic component according to some embodiments of the present disclosure.
Figure 15:
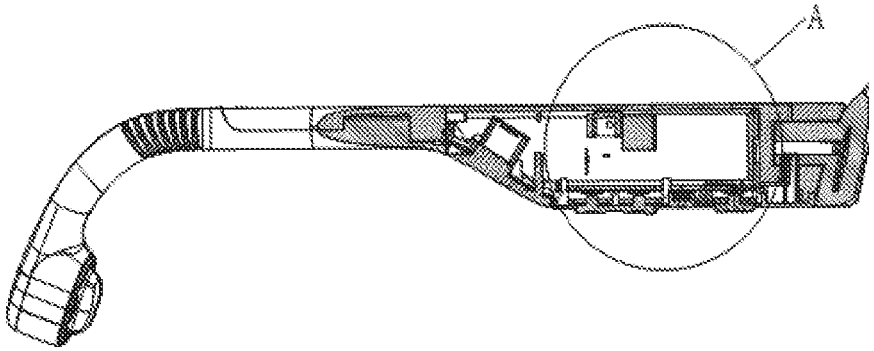
FIG. 15 is a schematic diagram illustrating a partial cross-section view of an electronic component according to some embodiments of the present disclosure.
Figure 16:
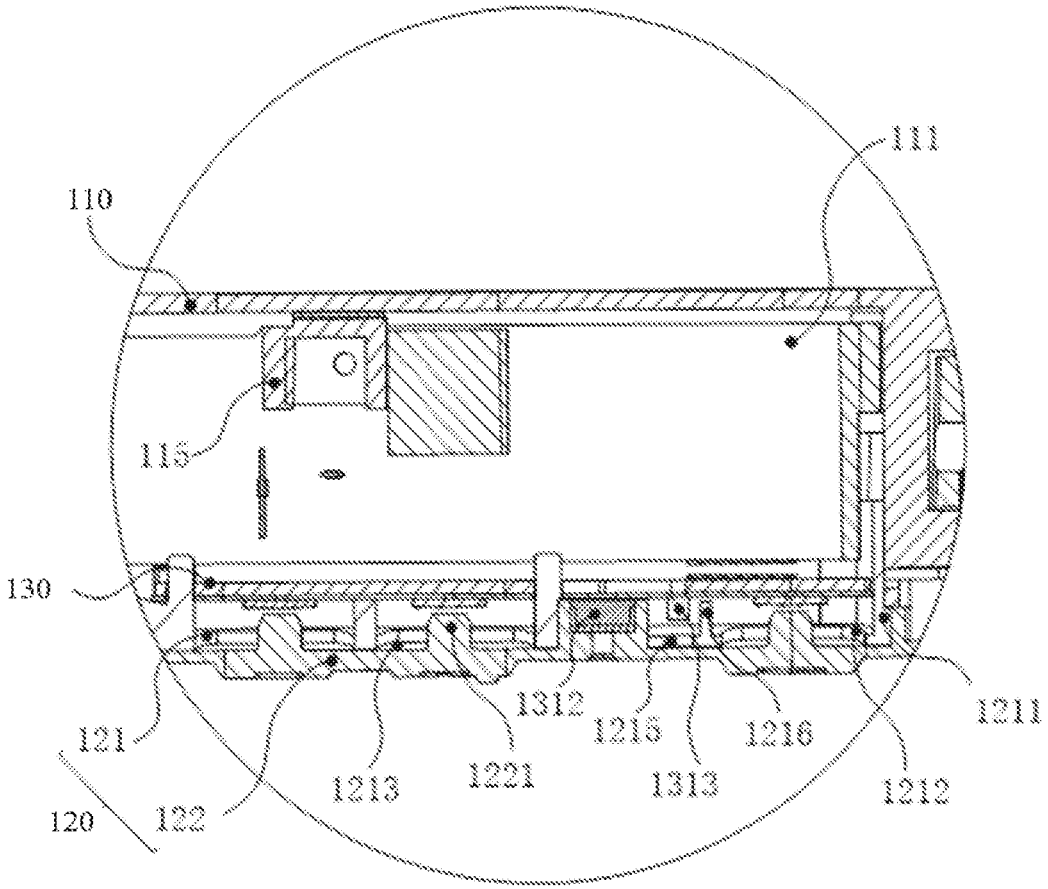
FIG. 16 is a schematic diagram illustrating an enlarged view of a part A in FIG. 15 according to some embodiments of the present disclosure.

FIG. 14 is a schematic diagram illustrating an exploded view of structures of an electronic component according to some embodiments of the present disclosure. FIG. 15 is a schematic diagram illustrating a partial cross-section view of an electronic component according to some embodiments of the present disclosure. FIG. 16 is a schematic diagram illustrating an enlarged view of a part A in FIG. 15 according to some embodiments of the present disclosure. The electronic component in the present disclosure may be applied to an electronic device. The electronic device may be any electronic device with internal structures to be sealed, such as an earphone, an MP3 player, a hearing aid, a mobile phone, a tablet computer, or glasses with a circuit component and the electronic device, etc., which are not specifically limited herein. In some embodiments, the electronic component may include the circuit housing 30 in FIG. 2 and internal circuit of the circuit housing 30. In some embodiments, the electronic component may also be referred to as a circuit housing.

According to FIGS. 14-16, in some embodiments, the electronic component (or the circuit housing) may include an accommodating body 110 and a cover 120. The accommodating body 110 may include a cavity 111 with an opening 112 at one end, and the cover 120 may be placed on the opening 112 of the cavity 111 for sealing the cavity 111.

In some embodiments, the accommodating body 110 may be at least part of the electronic device. The accommodating body 110 in this embodiment may specifically be a structure for holding, for example, a circuit board, a battery, and an electronic component in the electronic device, such as a whole or a part of the circuit housing 30 of the MP3 player. In some embodiments, the accommodating body 110 may include the cavity 111 having an opening 112 to accommodate the circuit board, the battery and the electronic component.

A shape of the cover 120 may at least partially match the opening 112, such that the cover 120 may be placed on the opening 112 to seal the cavity 111. The material of cover 120 may be different from or partially the same as the accommodating body 110. In some embodiments, the cover 120 may include a hard bracket 121 and a soft cover layer 122. The bracket 121 may be used to physically connect to the accommodating body 110. The cover layer 122 may be integrated on the surface of the bracket 121 to seal the cavity 111 after the bracket 121 is connected to the accommodating body 110.

In some embodiments, the material of the bracket 121 may be rigid plastic, and the material of the cover layer 122 may be soft silicone or rubber. A shape of the side of the bracket 121 facing toward the accommodating body 110 may match the opening 112, and fixed to the opening 112 of the cavity 111 by means of plugging, buckling, etc., so as to physically connect to the accommodating body 110. A gap may be easily formed at a physical connection portion between the rigid bracket 121 and the accommodating body 110, which may reduce a sealing effect of the cavity 111. Further, the soft cover layer 122 may be injection molded integrally on an outer surface of the bracket 121 away from the accommodating body 110, which may further cover the physical connection portion between the bracket 121 and the accommodating body 110, thereby sealing the cavity 111.

In some embodiments, the cover 120 may include a rigid bracket 121 and a soft cover layer 122 injection-molded integrally on a surface of the rigid bracket 121. The bracket 121 may be used to physically connect to the accommodating body 110. The cover layer 122 may further seal the cavity 111 after the bracket 121 is connected to the accommodating body 110. The soft cover layer 122 may be more conducive to fit the gap between the bracket 121 and the accommodating body 110, so as to further improve the sealing effect of the electronic component, thereby improving the waterproof performance of the electronic component. At the same time, bracket 121 and cover layer 122 may be injection molded integrally, which can simplify an assembly process of electronic components.

In some embodiments, the bracket 121 may include an insertion part 1211 and cover part 1212. The cover part 1212 may be placed on the opening 112, and the insertion part 1211 may be placed on one side of the cover part 1212 and extend into the cavity 111 along an inner wall of the cavity 111 to fix the cover part 1212 on the opening 112.

In some embodiments, the insertion part 1211 may not be inserted through the inner wall of cavity 111. For example, a plug-in part matching a shape of the insertion part 1211 of the bracket 121 may also be placed inside the cavity 111, such that the insertion part 1211 may be engaged with the plug-in part to fix the plug-in part inside the cavity 111. For example, the shape of insertion part 1211 may be a cylinder. In such cases, a plug-in part may be a cylindrical ring that surrounds the insertion part 1211 of the shape of the cylinder. An inner diameter of the plug-in part of the cylindrical ring may be appropriately less than an outer diameter of the plug-in part of the cylindrical body. In such cases, when inserting the insertion part 1211 in the plug-in part, an interference fit with the plug-in part may make the bracket 121 be stably connected to the cavity 111. Of course, other insertion methods may also be used, as long as the insertion part 1211 may be inserted into the cavity 111 and fixed with the cavity 111.

The cover part 1212 may be placed on a side of the insertion part 1211 facing away from the cavity 111, and cover the opening 112 after the insertion part 1211 is inserted into the cavity 111. The cover part 1212 may be a complete structure, or may further include some holes according to needs, so as to achieve a certain function.

Figure 17:
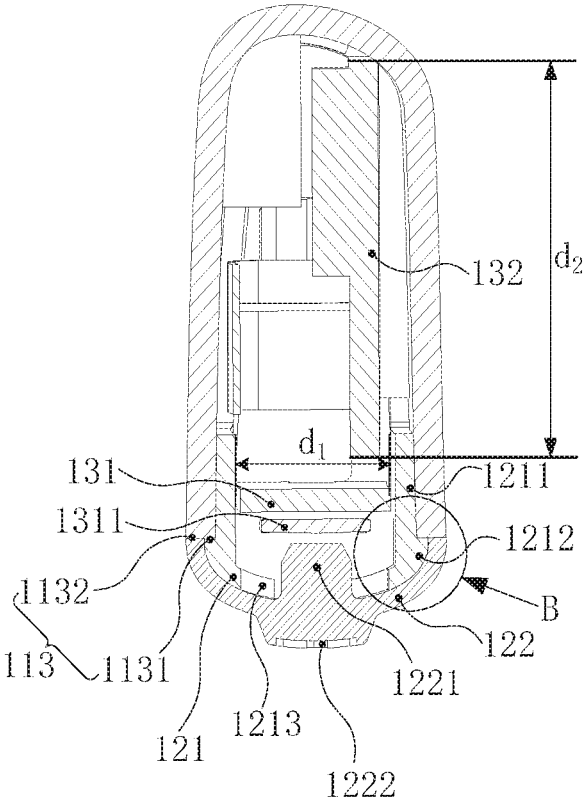
FIG. 17 is a schematic diagram illustrating a cross-section view of an electronic component in an assembled state along an A-A axis in FIG. 14 of the present disclosure.

FIG. 17 is a schematic diagram illustrating a cross-section view of an electronic component in an assembled state along an A-A axis in FIG. 14 according to some embodiments of the present disclosure. According to FIG. 14 and FIG. 17, in some embodiments, the accommodating body 110 may include an opening edge 113 for defining the opening 112. A cover part 1212 may be pressed on an inner region 1131 of the opening edge 113 near the opening 112. The cover layer 122 may cover an outer surface of the cover part 1212 away from the accommodating body 110, and may be pressed on an outer region 1132 outside the inner region 1131 of the opening edge 113, thereby sealing the cover layer 122 and the opening edge 113.

The inner region 1131 and the outer region 1132 of the opening edge 113 may both belong to the opening edge 113, and may be not other regions than the opening edge 113. The inner region 1131 of the opening edge 113 may be a region near the opening 112 of the opening edge 113, and the outer region 1132 of the opening edge 113 may be a region away from the opening 112 of the opening edge 113.

In some embodiments, the cover part 1212 of the bracket 121 may be pressed on the inner region 1131 of the opening edge 113 near the opening 112, which causes the cover part 1212 to initially seal the opening edge 113. However, since the accommodating body 110 and the bracket 121 are made of hard materials, a connection therebetween and a further coverage of the connection by the cover part 1212 may not achieve a good sealing effect. At an end where the cover part 1212 is pressed on the opening edge 113 and away from the opening 112, a gap between the end and the opening edge 113 may be easily generated. The end may further penetrate the cavity 111 through the gap, thereby reducing the sealing effect.

According to the descriptions above, in the embodiment of the present disclosure, the cover layer 122 may cover the outer surface of the cover part 1212 away from the accommodating body 110, and may be further pressed on the outer region 1132 outside the inner region 1131 of the opening edge 113, such that the gap between the cover part 1212 of the bracket 121 and the opening edge 113 may be further covered. Since the cover layer 122 is made of a soft material, it can further improve the sealing effect of the electronic component and make the electronic component more waterproof.

Figure 18:
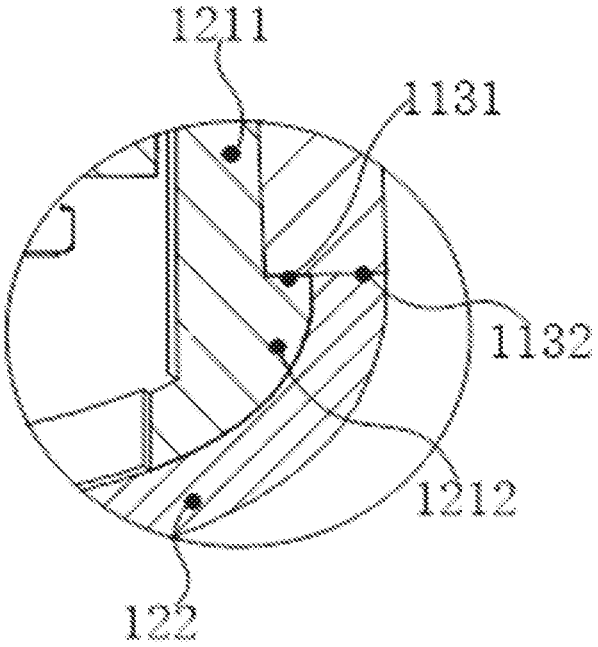
FIG. 18 is a schematic diagram illustrating an enlarged view of a part B in FIG. 17 according to some embodiments of the present disclosure.

FIG. 18 is a schematic diagram illustrating an enlarged view of a part B in FIG. 17 according to some embodiments of the present disclosure. According to FIG. 14, FIG. 17, and FIG. 18, in some embodiments, in a snapped state of the cover 120, a periphery of the cover part 1212 may cover the inner region 1131 of the opening edge 113 and contact the inner region 1131 of the opening edge 113. The cover layer 122 may be placed on a side of the cover part 1212 away from the accommodating body 110, such that the cover part 1212 of the inner region 1131 located at the opening edge 113 may be sandwiched between the inner region 1131 and the cover layer 122 of the opening edge 113. The cover layer 122 may further extend toward the cover part 1212 away from the opening 112, and toward the opening edge 113, until it contacts the outer region 1132 of the opening edge 113. Therefore, a contact end surface between the cover part 1212 and the opening edge 113 and a contact end surface between the cover layer 122 and the opening edge 113 may be flush with each other, so as to form an "opening edge 113-cover part 1212-cover layer 122" structure on the inner region 1131 of the opening edge 113.

Figure 19:
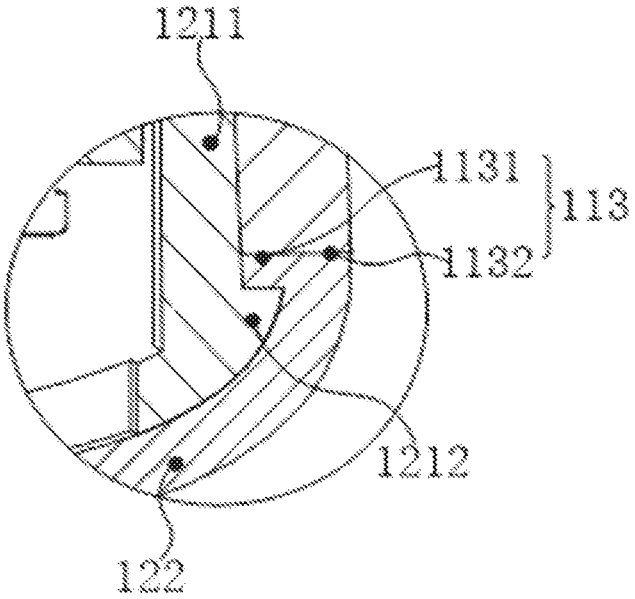
FIG. 19 is a schematic diagram illustrating a partial cross-section view of an electronic component according to some embodiments of the present disclosure.

FIG. 19 is a schematic diagram illustrating a partial cross-section view of an electronic component according to some embodiments of the present disclosure. According to FIG. 14, FIG. 16 and FIG. 19, in some embodiments, after the cover layer 122 extends to contact the outer region 1132 of the opening edge 113, the cover layer 122 may further extend along a region between the cover part 1212 and the opening edge 113 to the inner region 1131 of the opening edge 113. It is further assumed that, the cover part 1212 may be pressed on the inner region 1131 of the opening edge 113 to form an "opening edge 113-cover layer 122-cover part 1212-cover layer 122" structure between the inner region 1131 of the opening edge 113 and the cover part 1212. In some embodiments, the soft cover layer 122 may extend between the bracket 121 and the opening edge 113 after covering the cover part 1212 of the hard bracket 121, thereby further improving the sealing effect between the cavity 111 and the cover 120, and further improving the waterproof effect of the electronic component.

In some embodiments, the electronic component may further include a circuit component 130 placed in the cavity 111, and the circuit component 130 may include a switch 1311. In some embodiments, the circuit component 130 may include a first circuit board 131, and the switch 1311 may be placed on an outer side of the first circuit board 131 facing toward the opening 112 of the cavity 111.

Correspondingly, the bracket 121 may include a switch hole 1213 corresponding to the switch 1311. The cover layer 122 may further cover the switch hole 1213 and may include a pressing part 1221 at a position corresponding to the switch hole 1213. The pressing part 1221 may extend toward the inside of the cavity 111 through the switch hole 1213. When a corresponding position of the cover layer 122 is pressed, the pressing part 1221 may press the switch 1311 on the circuit component 130, thereby triggering the circuit component 130 to perform a preset function.

The pressing part 1221 on the cover layer 122 may be formed by protruding a side of the cover layer 122 facing toward the bracket 121 toward the switch hole 1213 and the switch 1311. A shape of the pressing part 1221 may match a shape of the switch hole 1213. In this way, when the corresponding position of the cover layer 122 is pressed, the pressing part 1221 may pass through the switch hole 1213 and reach the corresponding switch 1311 on the first circuit board 131. At the same time, a length of the pressing part 1221 along a direction of the switch 1311 may be set such that the switch 1311 is not pressed when the corresponding position of the cover layer 122 is not pressed, and the corresponding switch 1311 is pressed when the corresponding position of the cover layer 122 is pressed.

In some embodiments, a position corresponding to the pressing part 1221 on the cover layer 122 may further be protruded toward a side facing away from the bracket 121, so as to form a convex pressing part 1222. In this way, a user may clarify a position of the switch 1311, and trigger the circuit component 130 to perform a corresponding function by pressing the corresponding convex pressing part 1222.

Figure 20:
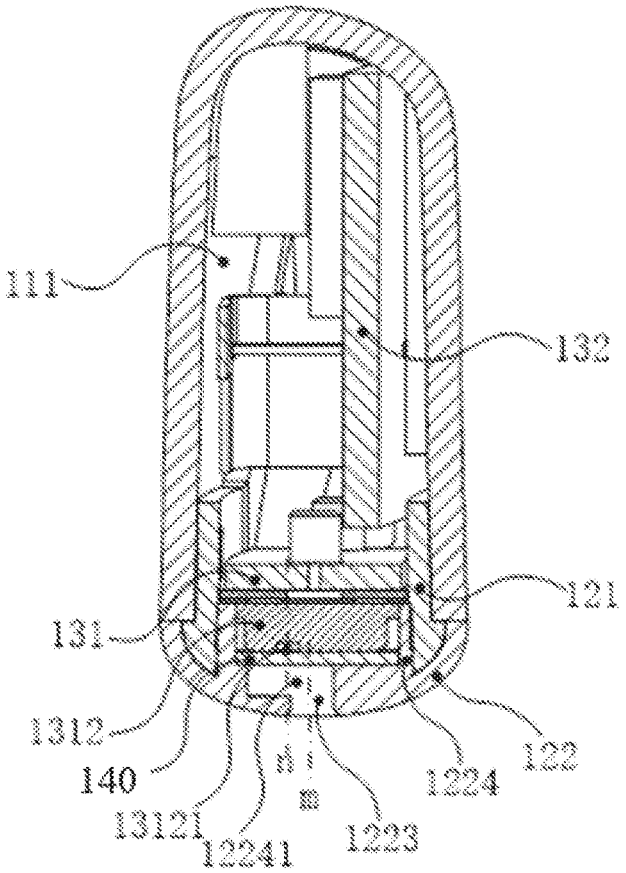
FIG. 20 is a schematic diagram illustrating a cross-section view of an electronic component in an assembled state along a B-B axis in FIG. 14 of the present disclosure.

FIG. 20 is a schematic diagram illustrating a cross-section view of an electronic component in an assembled state along a B-B axis in FIG. 14 according to some embodiments of the present disclosure. According to FIG. 14 and FIG. 20, the electronic component may include a first microphone element 1312. In some embodiments, the first microphone element 1312 may be placed on the first circuit board 131 of the circuit component 130 to be accommodated in the cavity 111. For example, the first microphone element 1312 may be placed on the first circuit board 131 at intervals from the switch 1311 in the embodiment. The first microphone element 1312 may be used to receive a sound signal from the outside of the electronic component, and convert the sound signal into an electrical signal for analysis and processing.

In some embodiments, the bracket 121 may include a microphone hole 1214 corresponding to the first microphone element 1312. The cover layer 122 may include a first sound guiding hole 1223 corresponding to the microphone hole 1214, and may include a first sound blocking member 1224 at a position corresponding to the microphone hole 1214. The first sound blocking member 1224 may extend inside the cavity 111 through the microphone hole 1214, and define a sound guiding channel 12241. One end of the sound guiding channel 12241 may be in communication with the first sound guiding hole 1223 on the cover layer 122. The first microphone element 1312 may be inserted into the sound guiding channel 12241 from the other end of the sound guiding channel 12241.

In some embodiments, the electronic component may also include the switch 1311 described above. The switch hole 1213 and the microphone hole 1214 may be placed on the bracket 121 at intervals.

In some embodiments, the first sound guiding hole 1223 may be placed through the cover layer 122 and correspond to a position of the first microphone element 1312. The first sound guiding hole 1223 may correspond to the microphone hole 1214 on the bracket 121, and further communicate the first microphone element 1312 with the outside of the electronic component, such that sound outside the electronic component may be received by the first microphone element 1312 through the first sound guiding hole 1223 and the microphone hole 1214.

The first sound guiding hole 1223 may be in any shape, as long as it can receive sound from the outside of the electronic component. In some embodiments, the first sound guiding hole 1223 may be a circular hole with a relatively small size, and may be placed in a region of the cover layer 122 corresponding to the microphone hole 1214. The small first sound guiding hole 1223 may reduce the communication between the first microphone element 1312 or the like in the electronic component with the outside, thereby improving the sealing effect of the electronic component.

In some embodiments, the first sound blocking member 1224 may extend from the cover layer 122, to a periphery of the first sound guiding hole 1223, through the microphone hole 1214, inside the cavity 111, to a periphery of the first microphone element 1312, to form a sound guiding channel 12241 from the first sound guiding hole 1223 to the first microphone element 1312. Thus, the sound signal of the electronic component entering the sound guiding hole may directly reach the first microphone element 1312 through the sound guiding channel 12241.

In some embodiments, a shape of a cross section of the sound guiding channel 12241 perpendicular to a length direction thereof may be the same as or different from a shape of the microphone hole 1214 or the first microphone element 1312. In some embodiments, shapes of cross sections of the microphone hole 1214 and the first microphone element 1312 in a direction perpendicular to the bracket 121 facing toward the cavity 111 may be square. A size of the microphone hole 1214 may be slightly larger than an outside size of the sound guiding channel 12241. An inside size of the sound guiding channel 12241 may be not smaller than the outside size of the first microphone element 1312, such that the sound guiding channel 12241 may pass through the first sound guiding hole 1223 to reach the first microphone element 1312 and cover the periphery of the first microphone element 1312.

In this way, the cover layer 122 of the electronic component may include a first sound guiding hole 1223 and a sound guiding channel 12241. The sound guiding channel 12241 may pass from the periphery of the first sound guiding hole 1223, through the microphone hole 1214 to reach the first microphone element 1312, and cover the periphery of the first microphone element 1312. The sound guiding channel 12241 may make the sound signal entering from the first sound guiding hole 1223 reach the first microphone element 1312 through the first sound guiding hole 1223, and may be received by the first microphone element 1312, which may reduce leakage of the sound signal in a propagation process, thereby improving the efficiency of receiving electronic signals of the electronic components.

In some embodiments, the electronic component may further include a waterproof mesh 140 placed in the sound guiding channel 12241. The waterproof mesh 140 may abut a side of the cover layer 122 facing toward the microphone element by the first microphone element 1312, and cover the first sound guiding hole 1223.

In some embodiments, the bracket 121 in the sound guiding channel 12241 close to the first microphone element 1312 may form a convex surface corresponding to the first microphone element 1312, such that the waterproof mesh 140 may be sandwiched between the first microphone element 1312 and the convex surface. The waterproof mesh 140 may also be directly bonded to a periphery of the first microphone element 1312, and the setting manner thereof is not limited here.

In addition to waterproofing the first microphone element 1312, the waterproof mesh 140 in this embodiment may also have effects such as sound transmission, so as to avoid affecting a sound receiving performance of a sound receiving region 13121 of the first microphone element 1312.

In some embodiments, the cover 120 may be in a bar shape. A main axis of the first sound guiding hole 1223 and a main axis of the sound receiving region 13121 of the first microphone element 1312 may be spaced from each other in a width direction of the cover 120. The main axis of the sound receiving region 13121 of the first microphone element 1312 may refer to a main axis of the sound receiving region 13121 of the first microphone element 1312 in the width direction of the cover 120, such as the axis n in FIG. 20. The main axis of the first sound guiding hole 1223 may be the axis m in FIG. 20.

It should be noted that, due to a setting need for the circuit component 130, the first microphone element 1312 may be placed at a first position of the first circuit board 131. When the first sound guiding hole 1223 is disposed, the first sound guiding hole 1223 may be placed at a second position of the cover 120 due to requirements of beauty and convenience. In this embodiment, the first position and the second position may not correspond to each other along the width direction of the cover 120, such that the main axis of the first sound guiding hole 1223 and the main axis of the sound receiving region 13121 of the first microphone element 1312 may be spaced from each other in the width direction of the cover 120. Therefore, the sound entering from the first sound guiding hole 1223 may not be able to reach the sound receiving region 13121 of the first microphone element 1312 in a straight line.

In some embodiments, in order to guide the sound signal entering from the first sound guiding hole 1223 to the first microphone element 1312, the sound guiding channel 12241 may be set to be curved.

In some embodiments, the main axis of the first sound guiding hole 1223 may be placed in the middle of the cover 120 in the width direction of the cover 120.

In some embodiments, the cover 120 may be part of a housing of the electronic device. In order to meet an overall aesthetic requirement of the electronic device, the first sound guiding hole 1223 may be placed in the middle of the cover 120 in the width direction, such that the first sound guiding hole 1223 may look more symmetrical and meet visual needs of people.

In some embodiments, the corresponding sound guiding channel 12241 may be disposed stepped/in a step shape along a cross-section along the B-B axis in FIG. 14, such that the sound signal introduced by the first sound guiding hole 1223 may be transmitted to the first microphone element 1312 through the sound guiding channel 12241 in the step shape and received by the first microphone element 1312.

Figure 21:
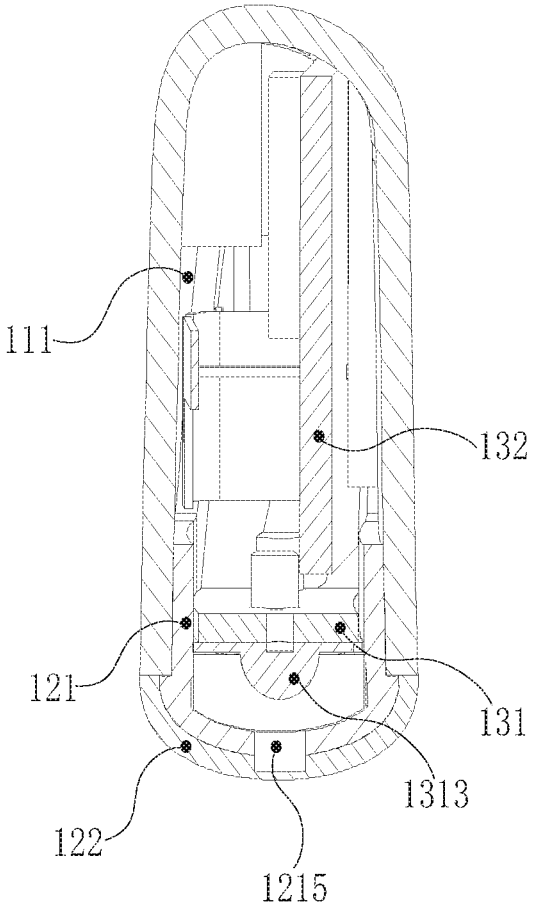
FIG. 21 is a schematic diagram illustrating a cross-section view of an electronic component in an assembled state along a C-C axis in FIG. 14 of the present disclosure.

FIG. 21 is a schematic diagram illustrating a cross-section view of an electronic component in an assembled state along a C-C axis in FIG. 14 according to some embodiments of the present disclosure. According to FIG. 14 and FIG. 21, in some embodiments, the electronic component may further include a light emitting element 1313. The light emitting element 1313 may be placed on the first circuit board 131 of the circuit component 130 to be accommodated in the cavity 111. For example, the light emitting element 1313 may be placed on the first circuit board 131 in a certain arrangement together with the switch 1311 and the first microphone element 1312 in the embodiment.

In some embodiments, the bracket 121 may include a light emitting hole 1215 corresponding to the light emitting element 1313. The cover layer 122 may cover the light emitting hole 1215, and a thickness of a region corresponding to the light emitting hole 1215 of the cover layer 122 may be set to allow light generated by the light emitting element 1313 to be transmitted through the cover layer 122.

In this embodiment, the cover layer 122 may still transmit light emitted from the light emitting element 1313 to the outside of the electronic component, by covering the light emitting hole 1215 with a certain means.

In some embodiments, a thickness of an entire region or part region of the cover layer 122 corresponding to the light emitting hole 1215 may be less than a thickness of a region of the cover layer 122 corresponding to a periphery of the light emitting hole 1215, such that the light emitted by the light emitting element 1313 may pass through the light emitting hole 1215 and may be transmitted through the cover layer 122. Of course, the region of the cover layer 122 covering the light emitting hole 1215 may transmit light through other means, which is not specifically limited here.

In some embodiments, the cover layer 122 may cover the light emitting hole 1215 of the corresponding light emitting element 1313, and may allow light emitted by the light emitting element 1313 to be transmitted from the cover layer 122 to the outside of the electronic component. Thus, the light-emitting element 1313 may be sealed by the cover layer 122 without affecting the light-emitting function of the electronic component, so as to improve the sealing effect and waterproof performance of the electronic component.

It should be noted that the above description regarding the electronic components is only a specific example, and should not be considered as the only feasible implementation. Obviously, for those skilled in the art, after understanding a basic principle of the loudspeaker apparatus, multiple variations and modifications may be made in the form and details of the specific manners and steps for implementing the loudspeaker apparatus, without departing from this principle. However, those variations and modifications do not depart from the scope of the present disclosure. For example, there may be one or more openings, which is not limited here. As another example, in some embodiments, there may be one or more switches. When there are a plurality of switches, the switches may be arranged on the first circuit board at intervals. All such variations are within the protection scope of the present disclosure.

In some embodiments, the loudspeaker apparatus (for example, an MP3 player) described above may transmit sound to a user through air conduction. When transmitting sound through air conduction, the loudspeaker apparatus may include one or more sound sources. The sound sources may be located at a specific position of the user's head, for example, a top of head, a forehead, a cheek, a cheek horn, an auricle, a back of auricle, etc., without blocking or covering the ear canal. For the purpose of description, FIG. 22 is a schematic diagram illustrating transmitting sound through air conduction according to some embodiments of the present disclosure.

Figure 22:
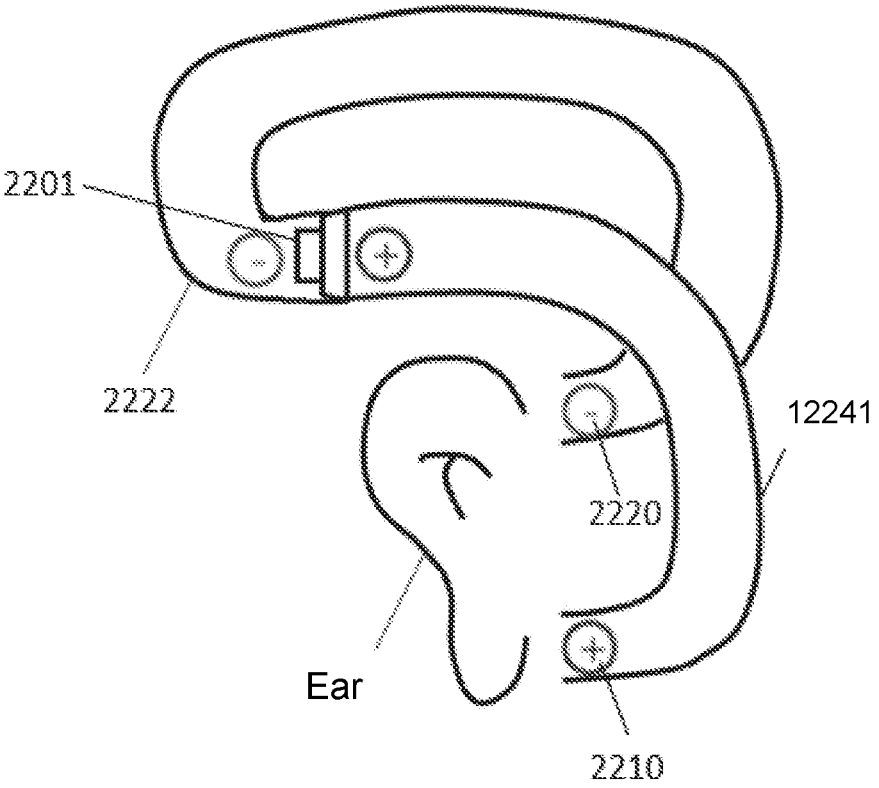
FIG. 22 is a schematic diagram illustrating transmitting sound through air conduction according to some embodiments of the present disclosure.

As shown in FIG. 22, a sound source 2210 and a sound source 2220 may generate sound waves with opposite phases ("+" and "−" in the figure indicate opposite phases). For simplicity, the sound sources mentioned here may refer to sound output holes on the loudspeaker apparatus. For example, the sound source 2210 and the sound source 2220 may be two sound outlet holes respectively located at specific positions on the loudspeaker apparatus (e.g., the earphone core housing 20, or the circuit housing 30).

In some embodiments, the sound source 2210 and the sound source 2220 may be generated by a same vibration apparatus 2201. The vibration apparatus 2201 may include a vibration diaphragm (not shown in the figure). When the vibration diaphragm is driven by an electric signal to vibrate, a front side of the vibration diaphragm may drive air to vibrate, vibrations may pass through the sound guiding channel 12241 to form the sound source 2210. A back side of the vibration diaphragm may drive air to vibrate, vibrations may pass through the sound guiding channel 12241 to form the sound source 2220. The sound guiding channel 12241 may refer to a sound propagation route from the vibration diaphragm to the corresponding sound hole. In some embodiments, the sound guiding channel 12241 may be a route surrounded by a specific structure (for example, the earphone core housing 20 or the circuit housing 30) on a loudspeaker apparatus. It should be noted that, in some alternative embodiments, the sound source 2210 and the sound source 2220 may also be generated by different vibration apparatus, respectively, through different diaphragm vibrations.

In the sound generated by the sound source 2210 and the sound source 2220, a part of the sound may be transmitted to the user's ear to form sound heard by the user, and the other part may be transmitted to the environment to form leaked sound. Considering that the sound source 2210 and the sound source 2220 are closer to the user's ear, for the convenience of description, the sound transmitted to the user's ear may be referred to as near-field sound, and the leaked sound transmitted to the environment may be referred to as far-field sound. In some embodiments, the near-field/far-field sound of different frequencies generated by the loudspeaker apparatus may be related to a distance between the sound source 2210 and the sound source 2220. Generally speaking, the near-field sound generated by the loudspeaker apparatus may increase as the distance between the two sound sources increases, and the far-field sound (leaked sound) generated may increase as the frequency thereof increases.

For sound of different frequencies, the distance between the sound source 2210 and the sound source 2220 may be designed separately, such that low-frequency near-field sound (for example, sound with a frequency less than 800 Hz) generated by the loudspeaker apparatus may be as large as possible, and high-frequency far-field sound (for example, sound with a frequency greater than 2000 Hz) may be as small as possible. In order to achieve the above purpose, the loudspeaker apparatus may include two or more sets of two-point sound sources. Each set of two-point sound sources may include two sound sources similar to the sound source 2210 and the sound source 2220, and may generate sound with specific frequencies, respectively. Specifically, the first set of two-point sound sources may be used to generate low-frequency sound, and the second set of two-point sound sources may be used to generate high-frequency sound. In order to obtain large low-frequency near-field sound, a distance between two sound sources in the first set of two-point sound sources may be a larger value. Since the low-frequency signal has a longer wavelength, a larger distance between the two sound sources may not cause an excessive phase difference in the far-field, and may not form too much sound leakage in the far-field. In order to make the high-frequency far-field sound smaller, a distance between two sound sources in the second set of two-point sound sources may be a smaller value. Since the high-frequency signal has a shorter wavelength, a smaller distance between the two sound sources may avoid a formation of a large phase difference in the far-field, thus avoiding a formation of large sound leakage. The distance between the second set of two-point sound sources may be less than the distance between the first set of two-point sound sources.

The beneficial effects of the embodiments in the present disclosure may include but are not limited to: (1) the circuit housing may be tightly covered by the housing protective sleeve, and the circuit housing and the housing protective sleeve may be sealed and connected, which may improve the waterproof performance of the loudspeaker apparatus; (2) the elastic pad may cover the outside of the button hole, which may prevent external liquid from entering the inside of the circuit housing through the button hole, thereby achieving the waterproof performance of the button mechanism; (3) the outer surface of the circuit housing may be recessed with a glue tank surrounding a plurality of mounting holes, and a sealant may be applied in the glue tank, so as to seal and connect the housing protective sleeve and the circuit housing at the periphery of the mounting hole through the sealant, thereby preventing external liquid from entering the housing protective sleeve through the exposed hole, and further improving the waterproof performance of the loudspeaker apparatus; (4) the soft cover layer may be beneficial to fit the gap between the bracket and the accommodating body, so as to further improve the sealing effect of the electronic component, thereby improving the waterproof performance of the electronic component. It should be noted that different embodiments may have different beneficial effects. In different embodiments, the possible beneficial effects may be one or more of the above, or any combination thereof, or any other beneficial effects that may be achieved.

The basic concepts have been described above. Obviously, for those skilled in the art, the disclosure of the invention is merely by way of example, and is not limiting. Although not expressly stated here, those skilled in the art may make various modifications, improvements, and amendments to the present disclosure. These alterations, the improvements and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment in connection with at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. Furthermore, some features, structures, or features in the present disclosure of one or more embodiments may be appropriately combined.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer-readable media having computer readable program code embodied thereon.

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure method does not mean that the present disclosure object requires more features than the features mentioned in the claims. Rather, claimed subject matter may lie in less than all features of a single foregoing disclosed embodiment.

In some embodiments, the numbers expressing quantities of ingredients, properties, and so forth, used to describe and claim certain embodiments of the application are to be understood as being modified in some instances by the term "about," "approximate," or "substantially" and etc. Unless otherwise stated, "about," "approximate," or "substantially" may indicate ±20% variation of the value it describes. Accordingly, in some embodiments, the numerical parameters set forth in the description and attached claims are approximations that may vary depending upon the desired properties sought to be obtained by a particular embodiment. In some embodiments, numerical data should consider the specified significant digits and use a method reserved for general digits. Notwithstanding that the numerical ranges and parameters configured to illustrate the broad scope of some embodiments of the present disclosure are approximations, the numerical values in specific examples may be as accurate as possible within a practical scope.

At last, it should be understood that the embodiments described in the present application are merely illustrative of the principles of the embodiments of the present application. Other modifications that may be employed may be within the scope of the application. Thus, by way of example, but not of limitation, alternative configurations of the embodiments of the application may be utilized in accordance with the teachings herein. Accordingly, embodiments of the present disclosure are not limited to the embodiments that are expressly introduced and described herein.

We claim:

1. A loudspeaker apparatus, comprising:

an earphone core housing configured to accommodate an earphone core;

a circuit housing including an accommodating body, a cover, a main side wall, and an auxiliary side wall connected to the main side wall, the accommodating body including a cavity with an opening at one end, the cover being disposed on the opening for sealing the cavity, the circuit housing accommodating a control circuit, the control circuit driving the earphone core to vibrate to generate sound, and an outer surface of the auxiliary side wall including a first recess region;

an ear hook configured to connect the earphone core housing and the circuit housing;

a button disposed at a button hole on the circuit housing, the button moving relative to the button hole to generate a control signal for the control circuit; and an elastic pad disposed between the button and the button hole, the elastic pad hindering a movement of the button toward the button hole, the elastic pad being placed in the first recess region, the elastic pad including a second recess region corresponding to the button hole, and the second recess region extending into the button hole.

2. The loudspeaker apparatus of claim 1, wherein the button includes a button body and a button contact, the button contact extending into the second recess region, and the button body being placed on a side of the button contact away from the elastic pad.

3. The loudspeaker apparatus of claim 2, wherein the circuit housing further accommodates a button circuit board, the button circuit board including a button switch corresponding to the button hole to allow the button contact to contact and trigger the button switch when a user presses the button.

4. The loudspeaker apparatus of claim 2, wherein the button includes at least two button monomers spaced from each other and a connecting part for connecting the button monomers, wherein each of the button monomers is provided with one button contact, and the elastic pad further includes an elastic convex for supporting the connecting part.

5. The loudspeaker apparatus of claim 1, wherein the loudspeaker apparatus further includes a rigid pad disposed between the elastic pad and the circuit housing, and the rigid pad includes a through hole that allows the second recess region to pass through.

6. The loudspeaker apparatus of claim 1, wherein the ear hook is fixed to the circuit housing in a plug-in manner, the ear hook being injection-molded with a housing protective sleeve, wherein the housing protective sleeve covers a periphery of the circuit housing and the button in a sleeve manner.

7. The loudspeaker apparatus of claim 6, wherein an opening end of the housing protective sleeve is disposed with a collar flange protruding inward, an end of the circuit housing away from the ear hook is stepped/in a step shape, thereby forming a circular table, when the housing protective sleeve covers the periphery of the circuit housing, the collar flange abuts the circular table.

8. The loudspeaker apparatus of claim 3, wherein the loudspeaker apparatus further includes an auxiliary film including a board and a pressing foot protruding from the board, and the pressing foot being used to press the button circuit board on an inner surface of the auxiliary side wall.

9. The loudspeaker apparatus of claim 8, wherein the main side wall of the circuit housing includes at least one mounting hole, and the loudspeaker apparatus further includes a conductive column inserted into the mounting hole; and the board includes a hollow region, wherein the board is disposed on an inner surface of the main side wall, and the mounting hole is located inside the hollow region, such that a glue tank is formed on a periphery of the conductive column.

10. The loudspeaker apparatus of claim 9, wherein the hollow region includes a notch, the inner surface of the main side wall is integrated with a striped convex rib corresponding to the notch, such that the striped convex rib and the auxiliary film are combined to make the glue tank closed.

11. The loudspeaker apparatus of claim 9, wherein the conductive column includes a columnar body inserted into the mounting hole, an outer peripheral surface of the columnar body includes a locating boss, the locating boss being clamped to the main side wall, thereby fixing the conductive column to the mounting hole.

12. The loudspeaker apparatus of claim 11, wherein the columnar body is divided into a first columnar body and a second columnar body along an insertion direction of the columnar body with respect to the mounting hole, a cross-section of the first columnar body perpendicular to the insertion direction being larger than a cross-section of the second columnar body perpendicular to the insertion direction; and the locating boss is placed on the second columnar body, the mounting hole being divided into a first hole section and a second hole section with cross-sections corresponding to the first columnar body and the second columnar body along the insertion direction respectively, such that a circular table is formed at a junction of the first hole section and the second hole section, when the columnar body is inserted into the mounting hole, the first columnar body is supported on the circular table, and the locating boss is clamped to the inner surface of the main side wall.

13. The loudspeaker apparatus of claim 12, wherein the columnar body includes an accommodating chamber along an axial direction, an opening end of the accommodating chamber is on an end surface of the second columnar body facing toward the inside of the circuit housing; and the conductive column further includes a spring and a conductive contact inside the accommodating chamber, one end of the conductive contact abutting the spring, and another end being exposed from the opening end of the accommodating chamber; and the loudspeaker apparatus further includes a main control circuit board disposed inside the circuit housing, the main control circuit board including a contact corresponding to a position of the conductive column, and the spring elastically pressing the conductive contact on the contact.

14. The loudspeaker apparatus of claim 13, wherein a main surface of the main control circuit board axial vertically set respect to the conductive column.

15. The loudspeaker apparatus of claim 1, wherein the cover includes a bracket and a cover layer injection-molded integrally on a surface of the bracket, the bracket being used to physically connect the accommodating body, and the cover layer being used to seal the cavity after the bracket is connected to the accommodating body.

16. The loudspeaker apparatus of claim 15, wherein, the bracket includes an insertion part and a cover part, the cover part being disposed on the opening, the insertion part being disposed on one side of the cover part and extending into the cavity along an inner wall of the cavity, so as to fix the cover part on the opening.

17. The loudspeaker apparatus of claim 16, wherein the accommodating body includes an opening edge defining the opening, the cover part is pressed on an inner region of the opening edge near the opening, the cover layer covers an outer surface of the cover part away from the accommodating body, and is pressed on an outer region outside the inner region of the opening edge, thereby sealing the cover layer and the opening edge.

18. The loudspeaker apparatus of claim 17, wherein in a snapped state, a contact end surface between the cover part and the opening edge is flush with a contact end surface between the cover layer and the opening edge, or the cover layer further extends between the cover part and the opening edge, and is pressed on the inner region of the opening edge by the cover part.

19. The loudspeaker apparatus of claim 15, wherein a cavity of the accommodating body includes a circuit component, the circuit component including a switch; and the bracket includes a switch hole corresponding to the switch, the cover layer covering the switch hole and including a pressing part at a position corresponding to the switch hole, the pressing part extending toward the inside of the cavity through the switch hole; when a corresponding position of the cover layer is pressed, the pressing part pressing the switch on the circuit component, thereby triggering the circuit component to perform a preset function.

* * * * *